US009937727B2

(12) United States Patent
Aihara

(10) Patent No.: US 9,937,727 B2
(45) Date of Patent: Apr. 10, 2018

(54) IMAGE FORMING APPARATUS

(71) Applicant: Yuichi Aihara, Yamanashi-ken (JP)

(72) Inventor: Yuichi Aihara, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/480,982

(22) Filed: Apr. 6, 2017

(65) Prior Publication Data

US 2017/0291428 A1 Oct. 12, 2017

(30) Foreign Application Priority Data

Apr. 6, 2016 (JP) ..... 2016-076471

(51) Int. Cl.
*B41J 17/00* (2006.01)
*B41J 2/325* (2006.01)

(52) U.S. Cl.
CPC ..... *B41J 2/325* (2013.01); *B41J 17/00* (2013.01)

(58) Field of Classification Search
CPC . B41J 2/325; B41J 2/0057; B41J 33/14; B41J 33/34; B41J 33/36; B41J 17/02; B41J 2/32; B41J 33/00; B41J 29/38; B41J 2002/012; B41J 2202/35; B41J 35/08; B41J 15/16; B41F 16/00
See application file for complete search history.

(56) References Cited

U.S. PATENT DOCUMENTS 9,139,018 B2 * 9/2015 Aihara ..... B41J 2/325
2012/0183341 A1 * 7/2012 Takahashi ..... B41J 2/325
400/225

FOREIGN PATENT DOCUMENTS

JP 2012-162069 A 8/2012
JP 2015-013468 A 1/2015

* cited by examiner

*Primary Examiner* — Huan Tran
(74) *Attorney, Agent, or Firm* — Manabu Kanesaka

(57) ABSTRACT

In order to provide an image forming apparatus capable of forming a high quality image on a film-shaped medium, the present printer includes an image forming section B1 that forms an image on a transfer film using an ink ribbon, a film conveying mechanism that has a motor Mr4 and conveys the transfer film while applying a tension thereto, an ink ribbon conveying section that has a motor Mr3 and conveys the ink ribbon while applying a tension thereto, and a control section that controls the image forming section B1, motor Mr3, and motor Mr4. When adjusting the drive amount of one of the motors Mr3 and Mr4, the control section also adjusts the drive amount of the other one thereof according to the adjustment amount of the one motor.

9 Claims, 20 Drawing Sheets

IMAGE FORMING APPARATUS

BACKGROUND OF THE INVENTION

Field of the Invention

The present invention relates to an image forming apparatus and, particularly, to an image forming device that forms an image on a film-shaped medium by using an ink ribbon.

Description of the Related Art

There is widely known an image forming apparatus that forms on an image on a film-shaped transfer medium. For example, such an image forming apparatus adopts an indirect printing system that forms an image (mirror image) on a transfer medium using an ink ribbon and then transfers the image formed on the transfer medium onto a surface of a printing medium such as a card or a disk.

In such an apparatus, in an image forming section thereof, a heating element constituting a thermal head is used to heat an ink ribbon and a transfer medium conveyed while being nipped between a platen roller and the thermal head from the ink ribbon side according to printing data, and thereby an image is formed on the transfer medium. Nowadays, during the image forming process, color printing in which images of a plurality of colors are overlapped with one another is widely carried out.

It is often the case in such an apparatus that a transfer medium is housed in a cassette provided with a feeding spool for feeding an unused part of an image formation region (image formation region before image formation) and a winding spool for winding an used part of the image formation region (image formation region after image formation) and, similarly, an ink ribbon in which ink panels of a plurality of colors are repeated in a face sequential manner is often housed in a cassette.

Generally, the transfer medium and ink ribbon are conveyed while laid over the upstream and downstream sides of an image forming section, and the conveying distance thereof is comparatively long. In view of this, there are provided motors for driving the feeding and winding spools, and a predetermined tension is applied to the transfer medium and ink ribbon in order to ensure their conveyance accuracy.

As disclosed in Patent Document 1 and Patent Document 2, the outer diameters of the transfer medium and ink ribbon wound around the feeding and winding spools vary every time an image is formed on the transfer medium in the image forming section, so that a drive amount (duty ratio) for motor driving is controlled in these motors.

PRIOR ART DOCUMENT

Patent Document

[Patent Document 1] Japanese Patent Application Publication No. 2015-13468 (see paragraphs [0028] and [0060])

[Patent Document 2] Japanese Patent Application Publication No. 2012-162069 (see paragraphs [0053] and [0054])

However, when rotational unevenness occurs in a drive source (motor) that drives the spool of the transfer medium or ink ribbon, its influence is reflected on the image forming process, which may result in appearance of uneven gradation irrelevant to printing data in an image formed on the transfer medium. This uneven gradation is also called "pitch unevenness". The lower the rotation speed of the drive source, the more likely the influence of the rotational unevenness on the image formation region of the transfer medium appears, and the more noticeable the pitch unevenness becomes. The rotation speed of the drive source becomes low when the outer diameter of the transfer medium or ink ribbon wound around the spool is large (the roll diameter of the transfer medium or ink ribbon wound around the spool is large). Further, the higher a back tension applied to the transfer medium or ink ribbon is, the more likely the rotational unevenness appears as the pitch unevenness.

The pitch unevenness is eliminated when the motor drive amount is corrected (for example, the motor duty ratio is increased) to reduce the back tension on the transfer medium side; however, when the back tension is excessively reduced, the transfer medium may be pulled to the ink ribbon winding side by the drive force of a motor disposed on the ink ribbon winding side to excessively advance since the transfer medium and ink ribbon are conveyed at the same speed and in the same direction at image formation. This issue may arise not only on the transfer medium side, but also on the ink ribbon side.

SUMMARY OF THE INVENTION

The present invention has been made in view of the above problems, and the object thereof is to provide an image forming apparatus capable of forming a high quality image on a medium.

To solve the above problem, according to the present invention, the present invention provides an image forming device comprising: an image forming unit that forms an image on a film-shaped medium using an ink ribbon; a first conveying unit that has a drive source and conveys the medium while applying a tension thereto; a second conveying unit that has a drive source and conveys the ink ribbon while applying a tension thereto; and a controller that controls the image forming unit, first conveying unit, and second conveying unit, wherein one of the drive source of the first and second conveying units is a first drive source and the other drive source is a second drive source, and when the controller adjusts a drive amount of the first drive source, the controller also adjusts a drive amount of the second drive source thereof according to the adjustment amount of the first drive source.

The image forming device according to the present invention further may include: a first detection unit that detects a rotation speed of the drive source of the first conveying unit; and a second detection unit that detects a rotation speed of the drive source of the second conveying unit, and when a smaller one of the rotation speeds of the drive sources detected by the first and second detection units is lower than a prescribed reference rotation speed, the controller may adjust the drive amount of the drive source having the smaller rotation speed as the first drive source.

The controller may perform adjustment such that the absolute value of the adjustment amount of the first drive source is equal to the absolute value of the adjustment amount of the second drive source and that the respective absolute values of the adjustment amounts are positively/negatively inverted. Further, the controller may adjust the drive amount of the first drive source in such a way that a back tension to be applied to the medium or ink ribbon is reduced.

The first and second conveying units may each have an upstream-side drive source and a downstream-side drive source respectively disposed upstream and downstream of the image forming unit, and when a smaller one of the rotation speeds of the upstream-side drive sources of the respective first and second conveying units is lower than a prescribed reference rotation speed, the controller may adjust the drive amount of the upstream-side drive source having the smaller rotation speed as the first drive source and adjust the drive amount of the other upstream-side drive source according to the adjustment amount of the first drive source as the second drive source.

In the above configuration, the upstream-side drive source and downstream-side drive source each preferably drive a winding spool or a feeding spool for the medium and ink ribbon, and the winding spool and feeding spool for the medium and ink ribbon are preferably disposed opposite to each other on the upstream and downstream sides of the image forming unit. Further, the image forming device according to the present invention may further include encoders that respectively detect rotation amounts of the upstream-side and downstream-side drive sources or the winding and feeding spools, and the controller may refer to an output of the encoder while the medium and ink ribbon are conveyed by a certain amount by the first and second conveying units to detect the drive amounts of the respective upstream-side and downstream-side drive sources.

The upstream-side and downstream-side drive sources may each be a PWM controlled DC motor, and the controller may change a duty ratio of the DC motor in PWM control to adjust the drive amounts of the first and the second upstream-side drive sources. In this case, the controller may increase the duty ratio of the first upstream-side drive source and reduces the second upstream-side drive source by an increase in the duty ratio of the first upstream-side drive source.

According to the present invention, when adjusting a drive amount of the drive source of one of the first and second conveying units, the controller also adjusts a drive amount of the drive source of the other one thereof according to the adjustment amount of the drive source of the one conveying unit, thereby making it possible to prevent the film-shaped medium and ink ribbon from excessively advancing at image formation by the image forming unit, whereby a high quality image can be formed on the film-shaped medium.

BRIEF DESCRIPTION OF THE DRAWINGS

FIGS. 12A and 12B are explanatory views each schematically explaining an image formation start position in an image formation region on a transfer film, in which FIG. 12A illustrates an image formation start position when an upstream-side mark in the printing direction is used, and FIG. 12B illustrates an image formation start position when a downstream-side mark in the printing direction is used;

FIGS. 16A to 16C are explanatory views each illustrating a use state of the transfer film and ink ribbon, in which FIG. 16A illustrates a case where both of the transfer film and ink ribbon are in a brand-new state, FIG. 16B a case where the both are in an intermediate state, and FIG. 16C a case where the both are in an empty state;

FIGS. 17A to 17C are explanatory views each schematically illustrating the relationship between a conveying speed of the transfer film and a back tension, in which FIG. 17A illustrates a case where a motor rotation speed is high, FIG. 17B a case where the motor rotation speed is low while the back tension is high, and FIG. 17C a case where the back tension is reduced;

FIGS. 19A and 19B are explanatory views each schematically illustrating the relationship among an object to be conveyed, a sensor output, and an encoder output, in which FIG. 19A illustrates the relationship among the transfer film, an output of a sensor for detecting the position of the transfer film, and an output of an encoder of the motor driving the winding spool for the transfer film, and FIG. 19B illustrates the relationship among the ink ribbon, an output of a sensor for detecting the position of the ink ribbon, and an output of an encoder of the motor driving the feeding spool for the ink ribbon;

FIGS. 20A to 20C are timing charts each schematically illustrating duty ratios of the motor driving the feeding spool for the ink ribbon and the motor driving the winding spool for the transfer film, in which FIG. 20A illustrates a case where the duty ratios of the former and the latter are adjusted from 40% and 60% to 42% and 58%, respectively, FIG. 20B illustrates a case where the duty ratios of the former and the latter are both adjusted to 50%, and FIG. 20C illustrates a case where the duty ratios of the former and the latter are adjusted from 60% and 40% to 58% and 42%, respectively.

DESCRIPTION OF THE PREFERRED EMBODIMENTS

Hereinafter, an embodiment in which the present invention is applied to a printer that prints and records text or images on a card while performing magnetic or electric information recording on the card will be described.

1. Configuration

1-1. System Configuration

Figure 1:
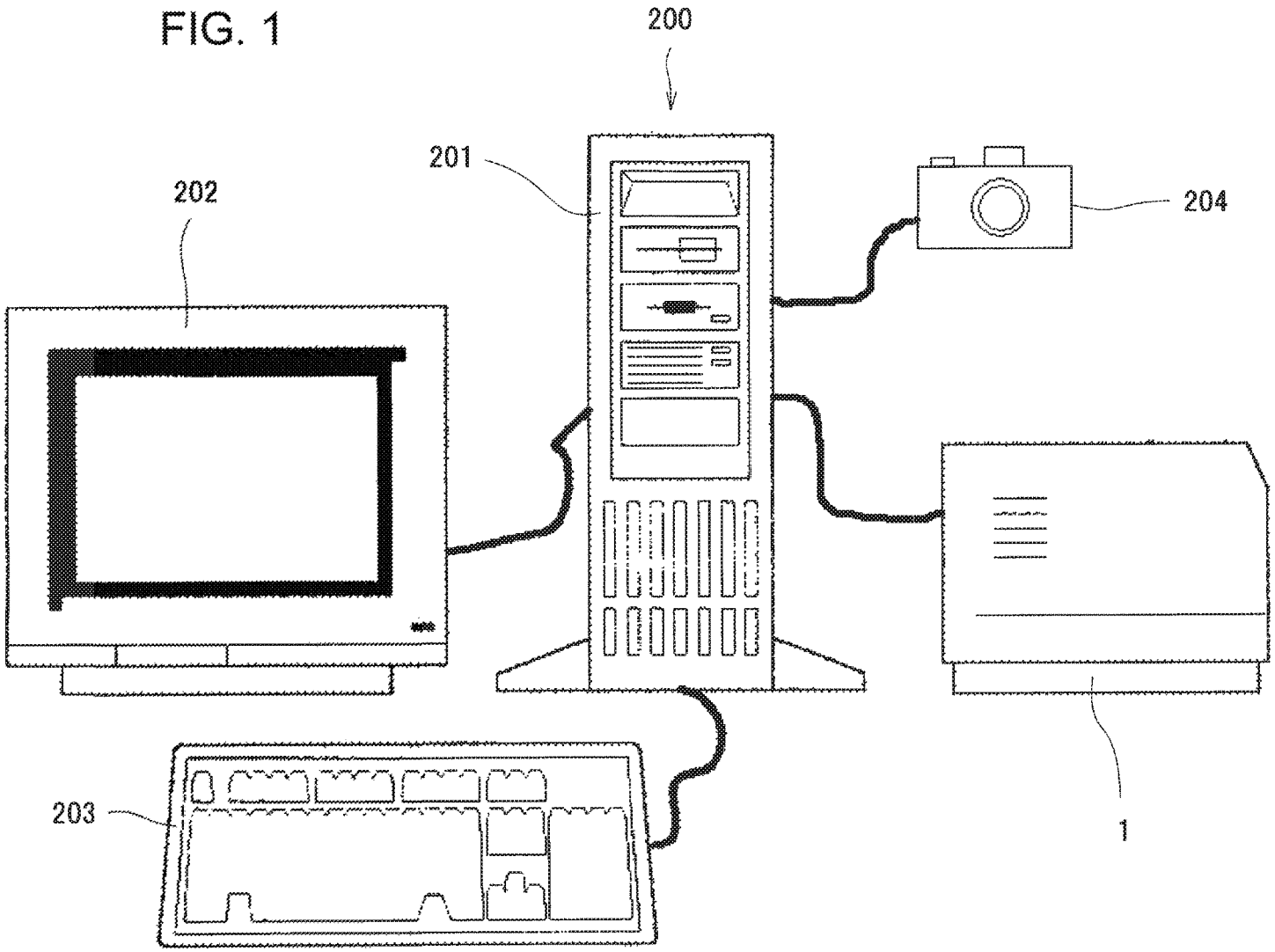
FIG. 1 is an outer appearance view of a printing system including a printer according to an embodiment of the present invention.
Figure 15:
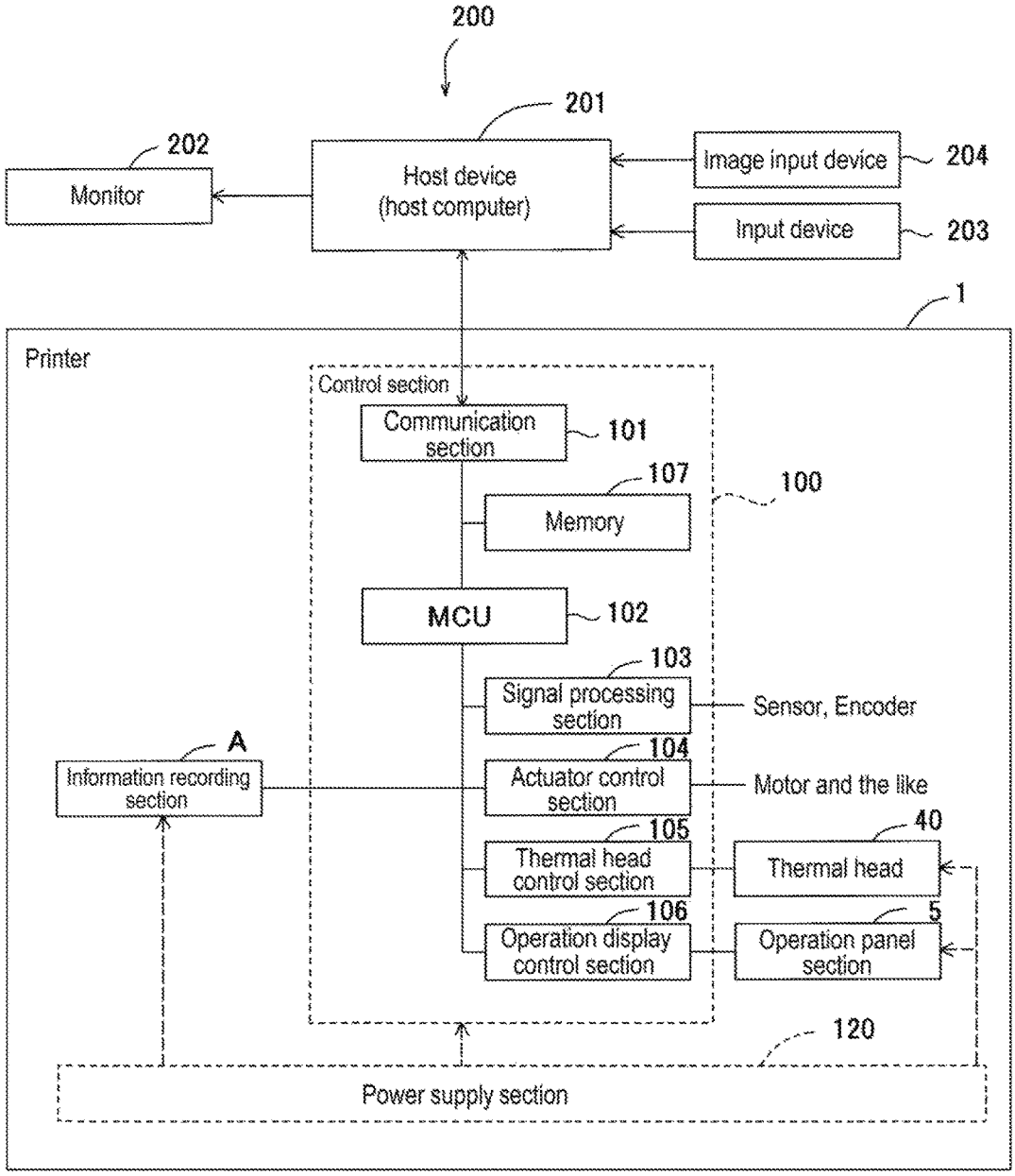
FIG. 15 is a block diagram schematically illustrating the configuration of a control section of the printer according to the embodiment.

As illustrated in FIGS. 1 and 15, a printer 1 according to the present embodiment constitutes a part of a printing system 200. That is, the printing system 200 roughly includes a host device 201 (for example, host computer such as a personal computer) and the printer 1.

The printer 1 is connected to the host device 201 through an unillustrated interface, and thus an operator can instruct the printer 1 to perform recording operation or the like by transmitting printing data or magnetic or electric recording data to the printer 1 through the host device 201. The printer 1 has an operation panel section (operation display section) 5 (see FIG. 15), and thus an operator can instruct the recording operation not only through the host device 201, but also through the operation panel section 5.

The host device 201 is connected with an image input device 204 such as a digital camera or scanner, an input device 203 such as a keyboard or a mouse to input a command and data to the host device 201, and a monitor 202 such as a liquid crystal display to display data generated in the host device 201.

1-2. Printer

1-2-1. Mechanism Section

Figure 2:
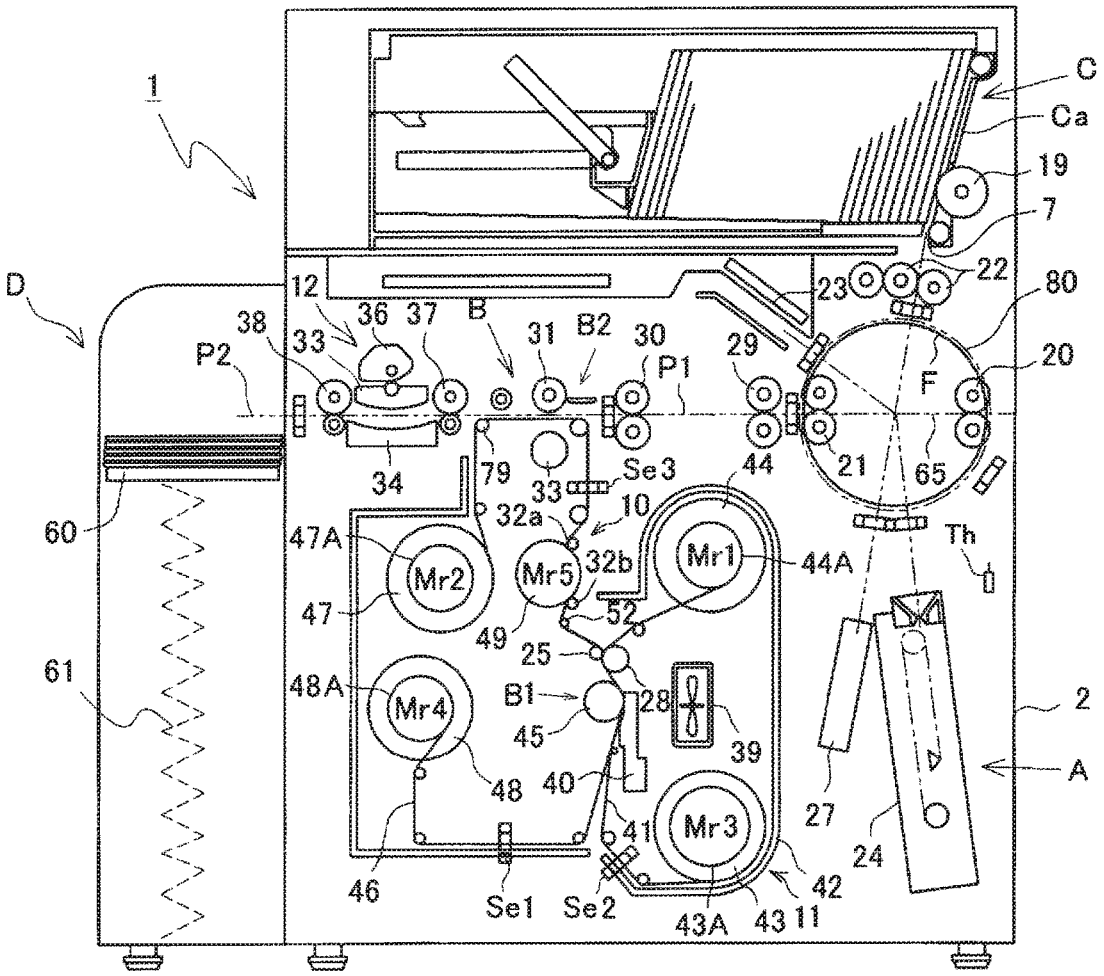
FIG. 2 is a front view schematically illustrating the configuration of the printer according to the embodiment.

As illustrated in FIG. 2, the printer 1 has a housing 2 and includes therein an information recording section A, a printing section B, a medium storage section C, a storage section D, and a rotary unit F.

(1) Information Recording Section A

The information recording section A includes a magnetic recording section 24, a non-contact type IC recording section 23, and a contact type IC recording section 27.

(2) Medium Storage Section C

The medium storage section C stores a plurality of cards Ca in an aligned state in a standing posture and has a separation opening 7 at the front end thereof. Through the separation opening 7, the cards Ca are sequentially fed by a pickup roller 19 starting from a card Ca in the first row. In the present embodiment, the card Ca has a standard size (85.6 mm wide and 53.9 mm tall).

(3) Rotary Unit F

The fed blank card Ca is sent to the rotary unit F by a carry-in roller 22. The rotary unit F includes a rotating frame 80 axially rotatably supported by the housing 2 and two roller pairs 20 and 21 supported by the rotating frame 80. The roller pairs 20 and 21 are axially rotatably supported by the rotating frame 80.

Around the outer periphery of the rotary unit F, there are disposed the above-mentioned magnetic recording section 24, non-contact type IC recording section 23, and contact type IC recording section 27. The roller pairs 20 and 21 form a medium conveying path 65 for conveying the card Ca to one of the information recording sections 23, 24, and 27, where data is magnetically or electrically written on the card Ca. In the vicinity of the rotary unit F, there is disposed a temperature sensor Th such as a thermistor that detects ambient temperature (external temperature). Based on the ambient temperature detected by the temperature sensor Th, temperatures of heating elements such as a thermal head (to be described later) and a heat roller (to be described later) provided in the printing section B are corrected.

(4) Printing Section

The printing section B forms an image such as a face photograph and text data on the front and back sides of the card Ca and is provided with a medium conveying path P1 for conveying the card Ca on the extension of the medium conveying path 65. Further, on the medium conveying path P1, there are disposed conveying rollers 29 and 30 that convey the card Ca, and the rollers 29 and 30 are connected to an unillustrated conveying motor.

The printing section B has a film conveying mechanism 10 and includes an image forming section B1 and a transfer section B2. The image forming section B1 uses a thermal head 40 to overlap images of different colors of an ink ribbon 41 to form an image on an image formation region (to be described later) of a transfer film 46 conveyed by the film conveying mechanism 10. The transfer section B2 transfers the image formed on the transfer film 46 onto the surface of the card Ca on the medium conveying path P1 by means of a heat roller 33.

On the downstream side of the printing section B, there is provided a medium conveying path P2 for conveying the printed card Ca to a storage stacker 60. On the medium conveying path P2, there are disposed conveying roller pairs 37 and 38 that convey the card Ca, and the rollers 37 and 38 are connected to an unillustrated conveying motor.

A decurl mechanism 12 is disposed between the conveying roller pairs 37 and 38. The decurl mechanism 12 presses downward the center portion of the card Ca whose both end portions are nipped by the conveying roller pairs 37 and 38 by means of a convex decurl unit 33 to nip the card Ca between the convex decurl unit 33 and a position-fixed concave decurl unit 34, thereby correcting a curl in the card Ca generated by thermal transfer by the heat roller 33. The decurl mechanism 12 is configured to advance and retreat in the vertical direction in FIG. 2 by a mechanism including an eccentric cam 36.

(5) Storage Section D

The storage section D is configured to store the cards Ca sent from the printing section B in the storage stacker 60. The storage stacker 60 is configured to be moved downward in FIG. 2 by a lifting mechanism 61.

(6) Details of Printing Section

Next, the printing section B of the printer 1 described above will be further described.

(6-1) Image Forming Section B1

The transfer film 46 has a band shape having a width slightly larger than the width of the card Ca and is formed by layering an ink reception layer that receives ink of the ink ribbon 41, a transparent protective layer that protects the surface of the ink reception layer, a peeling layer to promote integral peeling of the ink reception layer and protective layer with heat, and a substrate (base film) in this order from above.

Figure 12A:
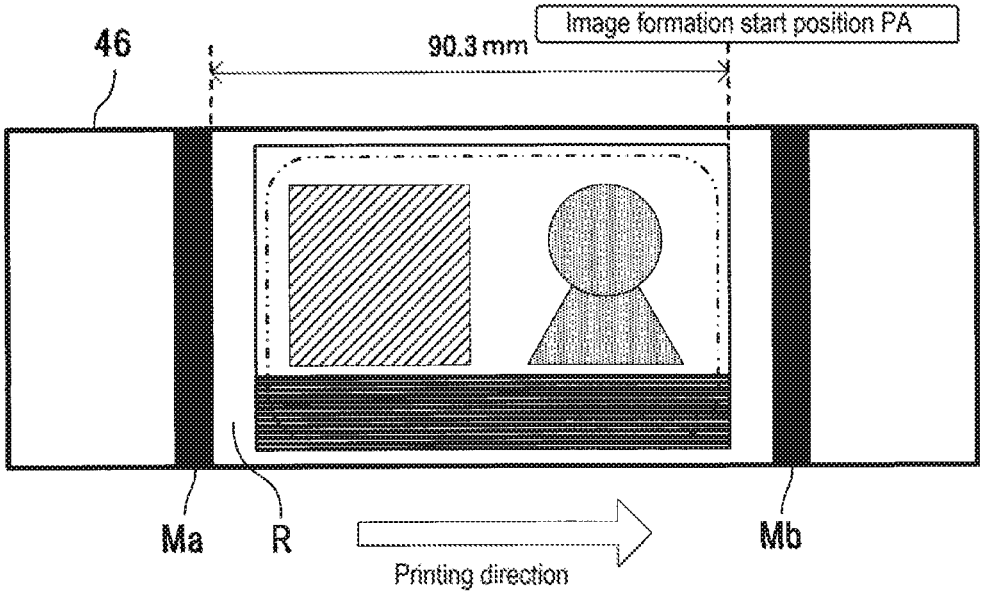
Figure 12B:
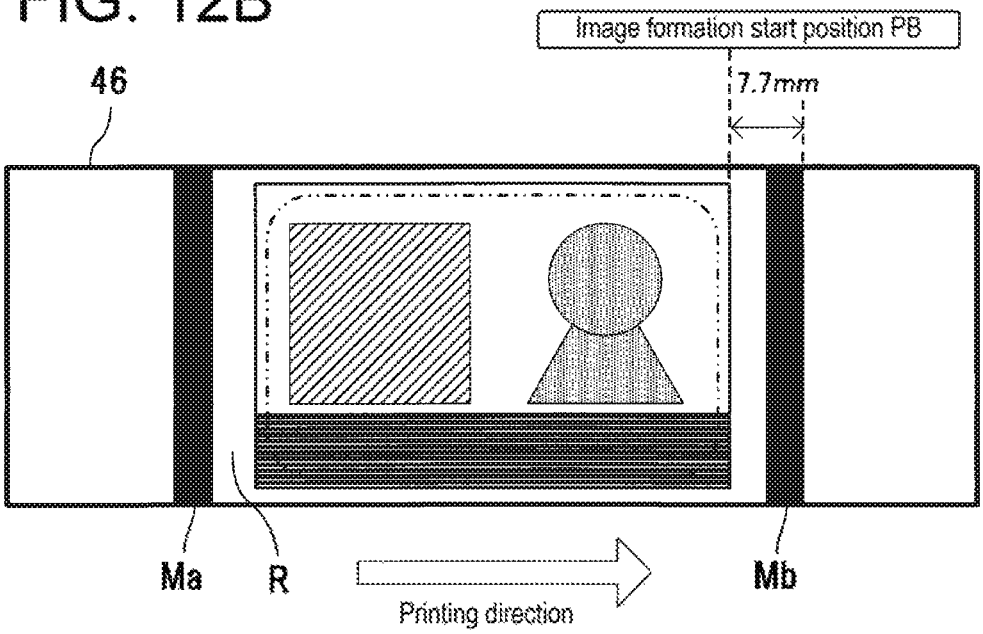

As illustrated in FIGS. 12A and 12B, in the transfer film 46 used in the present embodiment, marks for setting an image formation start position are formed at a regular interval so as to traverse the width direction (main scan direction of the thermal head 40) that crosses the printing direction (sub-scan direction of the thermal head 40) denoted by the arrow, and the region between the marks is defined as an image formation region R. More specifically, the image formation region R is defined by a mark Ma on the upstream side in the printing direction and a mark Mb on the downstream side. The dimension of the image formation region R in the printing direction (lateral direction in FIGS. 12A and 12B) is set to 94 mm, and that in the width direction (vertical direction in FIGS. 12A and 12B) is to 60 mm. The thickness (width) of each of the marks Ma and Mb is set to 4 mm. In the present embodiment, the transfer film 46 is stored in a transfer film cassette in an unused state, including 500 image formation regions R (screens).

As illustrated in FIG. 2, the transfer film 46 is wound and fed by a feeding roll 47 and a winding roll 48 that are rotated inside the transfer film cassette by driving of motors Mr2 and Mr4, respectively. In the transfer film cassette, a feeding spool 47A is disposed in the center of the feeding roll 47, and a winding spool 48A is disposed in the center of the winding roll 48. Rotation drive force of the motor Mr2 is transferred to the feeding spool 47A through an unillustrated gear, and rotation drive force of the motor Mr4 is transferred to the winding spool 48A through an unillustrated gear. Forward-backward rotatable DC motors are used for the motors Mr2 and Mr4. Further, an unillustrated encoder (hereinafter, referred to as "encoder for motor Mr2" and "encoder for motor Mr4") that detects the rotation speed of the motor Mr2 or Mr4 is provided to the motor shaft thereof at a position opposite to the output shaft side.

In the present embodiment, the transfer film 46 before undergoing transfer processing is wound around the feeding spool 47A, and used (part already subjected to transfer processing by the transfer section B2) transfer film 46 is wound around the winding spool 48A. Thus, when image formation processing and transfer processing are applied to the transfer film 46, the transfer film 46 is once fed from the feeding spool 47A to the winding spool 48A, and then image formation processing and transfer processing are performed while winding the transfer film 46 by the feeding spool 47A.

A film conveying roller 49 is a main drive roller for carrying the transfer film 46, and by controlling the driving of the roller 49, the conveying amount and the conveying stop position of the transfer film 46 are determined. The film conveying roller 49 is connected to a forward-backward rotatable film conveying motor Mr5 (stepping motor). Although the motors Mr2 and Mr4 are also driven when the film conveying roller 49 is driven, they are configured to wind the transfer film 46 fed from one of the feeding roll 47 and winding roll 48 by the other one to apply a tension to the conveyed transfer film 46. That is, the motors Mr2 and Mr4 perform an auxiliary function for film conveyance and are not driven as a main conveying source for the transfer film 46.

Pinch rollers 32*a* and 32*b* are disposed on the periphery of the film conveying roller 49. Although not illustrated in FIG. 2, the pinch rollers 32*a* and 32*b* are configured to advance and retreat with respect to the film conveying roller 49, and in the state illustrated in FIG. 2, the rollers 32*a* and 32*b* advance to the film conveying roller 49 to come into pressure-contact therewith, thereby winding the transfer film 46 around the film conveying roller 49. By this means, the transfer film 46 undergoes accurate conveyance by a distance according to the rotation speed of the film conveying roller 49.

Thus, by driving the film conveying roller 49 as the main drive roller disposed between the image forming section B1 and the transfer section B2, the film conveying mechanism 10 can convey the transfer film 46 forward and backward among the feeding roll 47, image forming section B1, transfer section B2, and winding roll 48 and can locate the image formation region R of the transfer film 46 and an image formed in the image formation region R at an adequate position (cueing position) in the image forming section B1 and transfer section B2. Further, there are disposed transmission-type sensors Se1 and Se3 between the winding roll 48 and the image forming section B1 (thermal head 40 and platen roller 45) and between the film conveying roller 49 and the transfer section B2 (heat roller 33 and platen roller 31), respectively. The sensors Se1 and Se3 each have a light-emitting element and a light-receiving element and detect the above-mentioned mark formed on the transfer film 46.

Hereinafter, the relationship between the marks Ma and Mb formed on the transfer film 46 and the image formation start position (printing start position of the thermal head 40) in the image formation region R on the transfer film 46 will be described.

(A) Case where Mark Ma is Used for Cueing

FIG. 12A schematically illustrates the image formation start position set with respect to the image formation region R on the transfer film 46 in the image forming section B1 in a case where the mark Ma on the upstream side relative to the image formation region R in the printing direction is used for cueing (when the mark Ma is detected by the sensor Se1). As illustrated in FIG. 12A, in the present embodiment, an image formation start position PA in the image formation region R when the mark Ma is used for cueing is set at a position of 90.3 mm from the front end of the mark Ma in the printing direction. In other words, the center of the length of the image formation region R in the printing direction and the center of the length of a region printable by the thermal head 40 (hereinafter, referred to as "printing region of the thermal head 40") in the printing direction are made to coincide with each other.

In FIG. 12A, the continuous line rectangular area within the image formation region R corresponds to the printing region of the thermal head 40, and the area denoted by the dashed double-dotted line corresponds to the card Ca. In the present embodiment, the printing region of the thermal head 40 is set to 86. 6 mm wide and 54.9 mm tall so as to have a margin of about 0.5 mm on the up, down, left, and right sides of the card Ca of standard size. In other words, the distance between the front end of the mark Ma and the printing region (image formation end position) of the thermal head 40 and the distance between the rear end of the mark Mb and the image formation start position PA are each 3.7 mm.

(B) Case where Mark Mb is Used for Cueing

FIG. 12B schematically illustrates the image formation start position set with respect to the image formation region R on the transfer film 46 in the image forming section B1 in a case where the mark Mb on the downstream side relative to the image formation region R in the printing direction is used for cueing. As illustrated in FIG. 12B, an image formation start position PB in the image formation region R when the mark Mb is used for cueing is set at a position of 7.7 mm from the front end of the mark Mb in the printing direction. In other words, the center of the length of the image formation region R in the printing direction and the center of the length of the printing region of the thermal head 40 in the printing direction are made to coincide with each other.

Referring back to FIG. 2, the ink ribbon 41 is stored in an ink ribbon cassette 42 in a state being stretched between a feeding roll 43 for feeding the ink ribbon 41 to the ink ribbon cassette 42 and a winding roll 44 for winding the ink ribbon 41. A winding spool 44A is disposed in the center of the winding roll 44, and a feeding spool 43A is disposed in the center of the feeding roll 43. The winding spool 44A is rotated by drive force of a motor Mr1, and the feeding spool 43A is rotated by drive force of a motor Mr3.

Forward-backward rotatable DC motors are used for the motors Mr1 and Mr3. Like the above-described motors Mr2 and Mr4, an unillustrated encoder (hereinafter, referred to as "encoder for motor Mr1" and "encoder for motor Mr3") that detects the rotation speed of the motor Mr1 or Mr3 is provided to the motor shaft thereof at a position opposite to the output shaft side. The motors Mr1 and Mr3 constitute an ink ribbon conveying section 11 (see FIG. 2) that conveys the ink ribbon 41. In the present embodiment, the feeding and winding spools 47A and 48A for the transfer film 46 and the feeding and winding spools 43A and 44A for the ink ribbon 41 are disposed opposite to each other on the upstream and downstream sides of the image forming section B1 (thermal head 40 and platen roller 45).

The ink ribbon 41 is configured by repeating color ink panels of Y (Yellow), M (Magenta), and C (Cyan) and a Bk (Black) ink panel in the longitudinal direction in a face sequential manner. In the present embodiment, sublimation ink is used for the color ink panels of Y, M, and C, and molten ink is used for the Bk ink panel. However, the sublimation ink may be used for the Bk ink panel. Further, a transmission type sensor Se2 is disposed between the feeding roll 43 and the image forming section B1 (thermal head 40 and platen roller 45). The transmission type sensor Se2 detects the position of the ink ribbon 41 by detecting a state where light from the light-emitting element is shielded on the light receiving element side by the Bk ink panel so as to perform the cueing of the ink ribbon 41 to be fed to the image forming section B1. In the present embodiment, the ink ribbon 41 is stored in the ink ribbon cassette 42 in an unused state, including ink panels of Y, M, C, and Bk corresponding to 500 screens which are repeated in a face sequential manner so as to correspond to the image formation regions R of the transfer film 46.

The platen roller 45 and thermal head 40 constitute the image forming section B1, and the thermal head 40 is disposed opposed to the platen roller 45. At image formation, the platen roller 45 is brought into pressure-contact with the thermal head 40 with the transfer film 46 and the ink ribbon 41 interposed therebetween. The thermal head 40 has a plurality of heating elements lined in the main scan direction. These heating elements are selectively heated under the control of a head control IC (not illustrated) according to printing data and form an image on the transfer film 46 through the ink ribbon 41. At this time, the transfer film 46 and ink ribbon 41 are conveyed at the same speed and in the same direction (printing direction illustrated in FIGS. 12A and 12B, i.e., upward direction in FIG. 2). The thermal head 40 is cooled by a cooling fan 39.

The ink ribbon 41 with which printing on the transfer film 46 is finished is peeled off from the transfer film 46 by means of a peeling roller 25 and a peeling member 28. The peeling member 28 is fixed to the ink ribbon cassette 42, the peeling roller 25 comes into contact with the peeling member 28 at image formation, and the roller 25 and peeling member 28 nip the transfer film 46 and ink ribbon 41 to perform peeling. The peeled ink ribbon 41 is wound around the winding roll 44 by drive force of the motor Mr1, and the transfer film 46 is conveyed to the transfer section B2 having the platen roller 31 and heat roller 33 by the film conveying roller 49.

(6-2) Transfer Section B2

In the transfer section B2, the transfer film 46 is nipped together with the card Ca by the heat roller 33 and platen roller 31, and an image formed in the image formation region R on the transfer film 46 is transferred to the surface of the card Ca. That is, at image transfer, the heat roller 33 is brought into pressure-contact with the platen roller 31 with the card Ca and transfer film 46 (image formation region R thereon) interposed therebetween, and the card Ca and transfer film 46 are conveyed at the same speed and in the same direction (see also FIG. 13). The heat roller 33 is mounted to a lifting mechanism (not illustrated) so as to come into pressure contact with and separate from the platen roller 31 through the transfer film 46.

Figure 13:
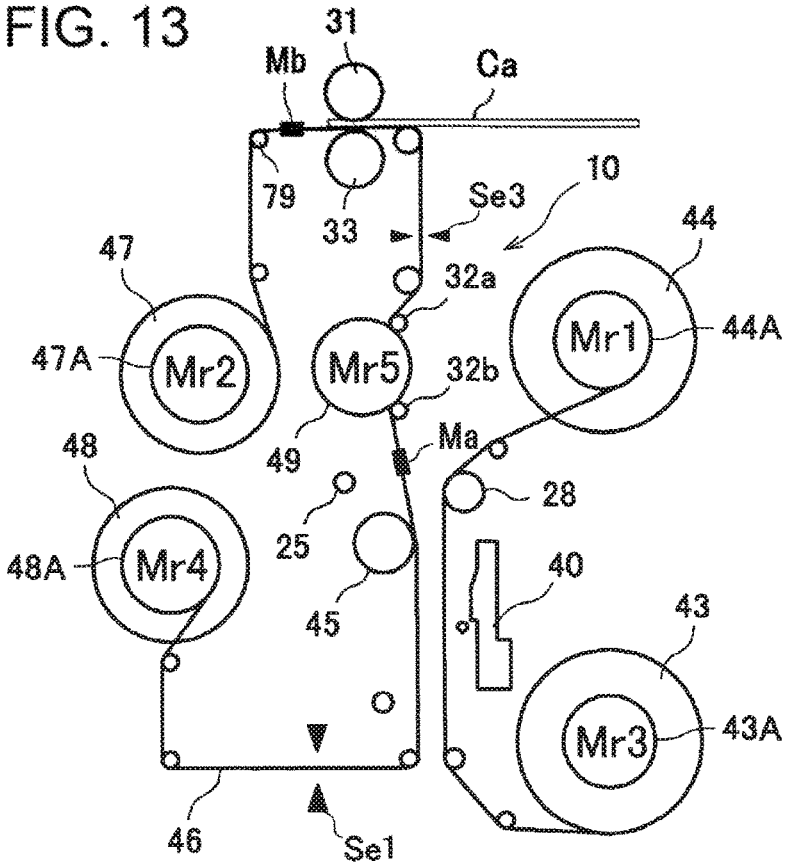
FIG. 13 is a front view of the printer according to the embodiment at secondary transfer.

FIG. 13 is a front view of the printer 1 in a state where secondary transfer processing is performed in the transfer section B2. At the secondary transfer processing, the mark Mb is detected by the sensor Se3 for cueing irrespective of whether the mark Ma or mark Mb is used for cueing. In the present embodiment, a position where the transfer film 46 is further conveyed by the film conveying motor Mr5 by 30 mm from the position where the sensor Se3 detects the front end of the mark Mb is set as a (secondary) transfer start position.

Figure 14:
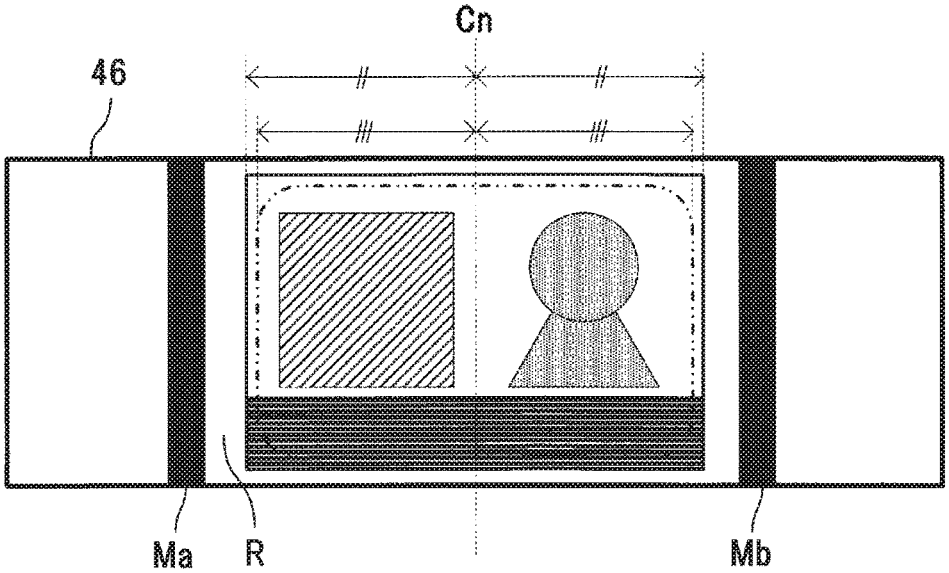
FIG. 14 is an explanatory view schematically illustrating the relationship between the transfer film and a card at secondary transfer.

FIG. 14 schematically illustrates alignment between the image formation region R and the card Ca. As illustrated in FIG. 14, in the secondary transfer processing, the transfer film 46 is cued in such a way that the center Cn of the length of the printing region of the thermal head 40 in the printing direction and the center of the card Ca in the longitudinal direction thereof are made to coincide with each other. This is achieved by further conveying the transfer film 46 by 30 mm from the position where the sensor Se3 detects the front end of the mark Mb.

The transfer film 46 after image transfer is separated (peeled off) from the card Ca by means of a peeling pin 79 disposed between the heat roller 33 and a driven roller 37*b* constituting the conveying roller pair 37 and conveyed to the feeding roll 47 side. On the other hand, the card Ca to which the image is transferred is conveyed downstream on the medium conveying path P2 toward the decurl mechanism 12.

(6-3) Details of Image Forming Section B1

Figure 3:
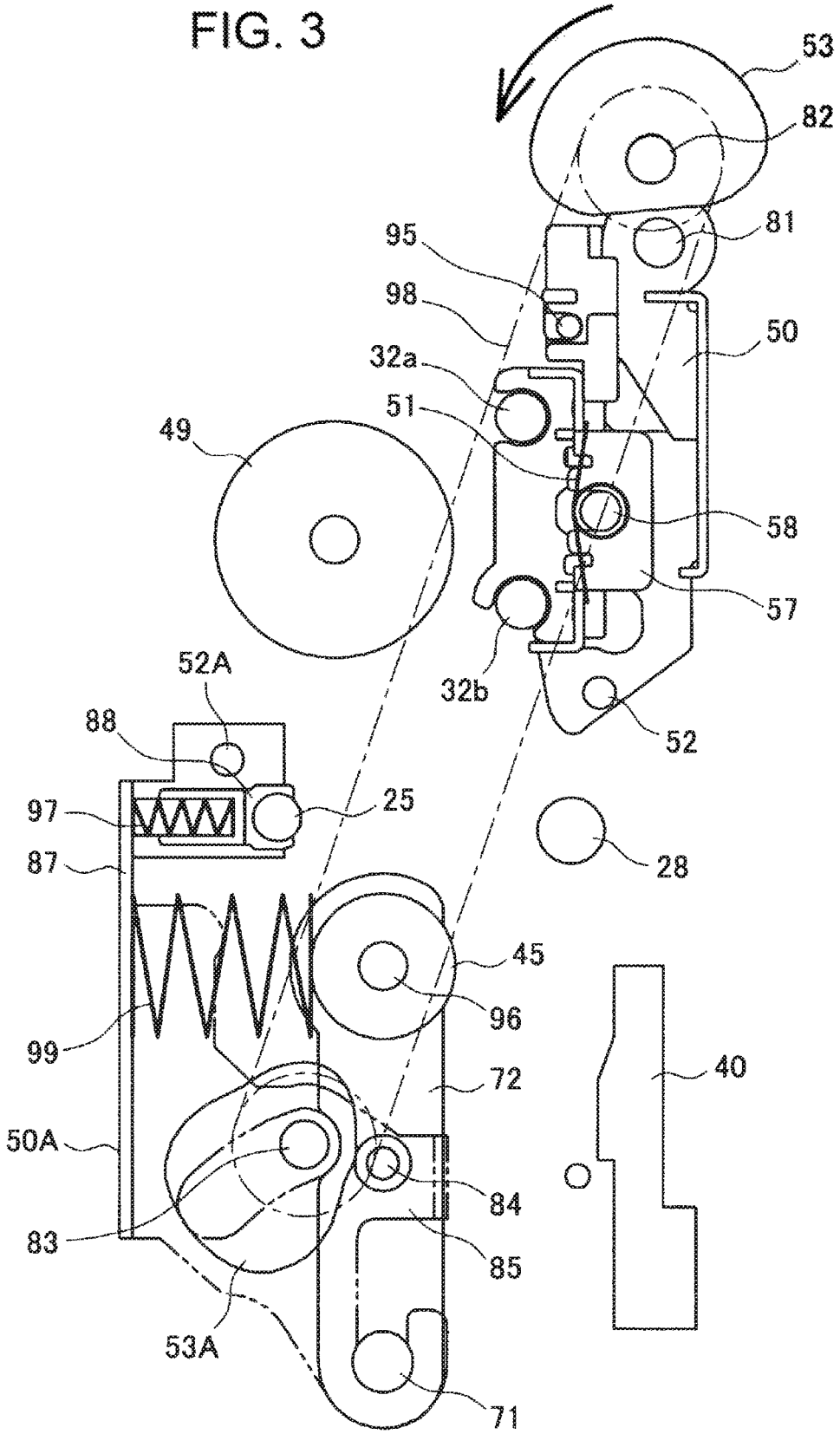
FIG. 3 is a view for explaining a control state using cams at a waiting position where pinch rollers and a film conveying roller are separated from each other, and a platen roller and a thermal head are separated from each other.
Figure 4:
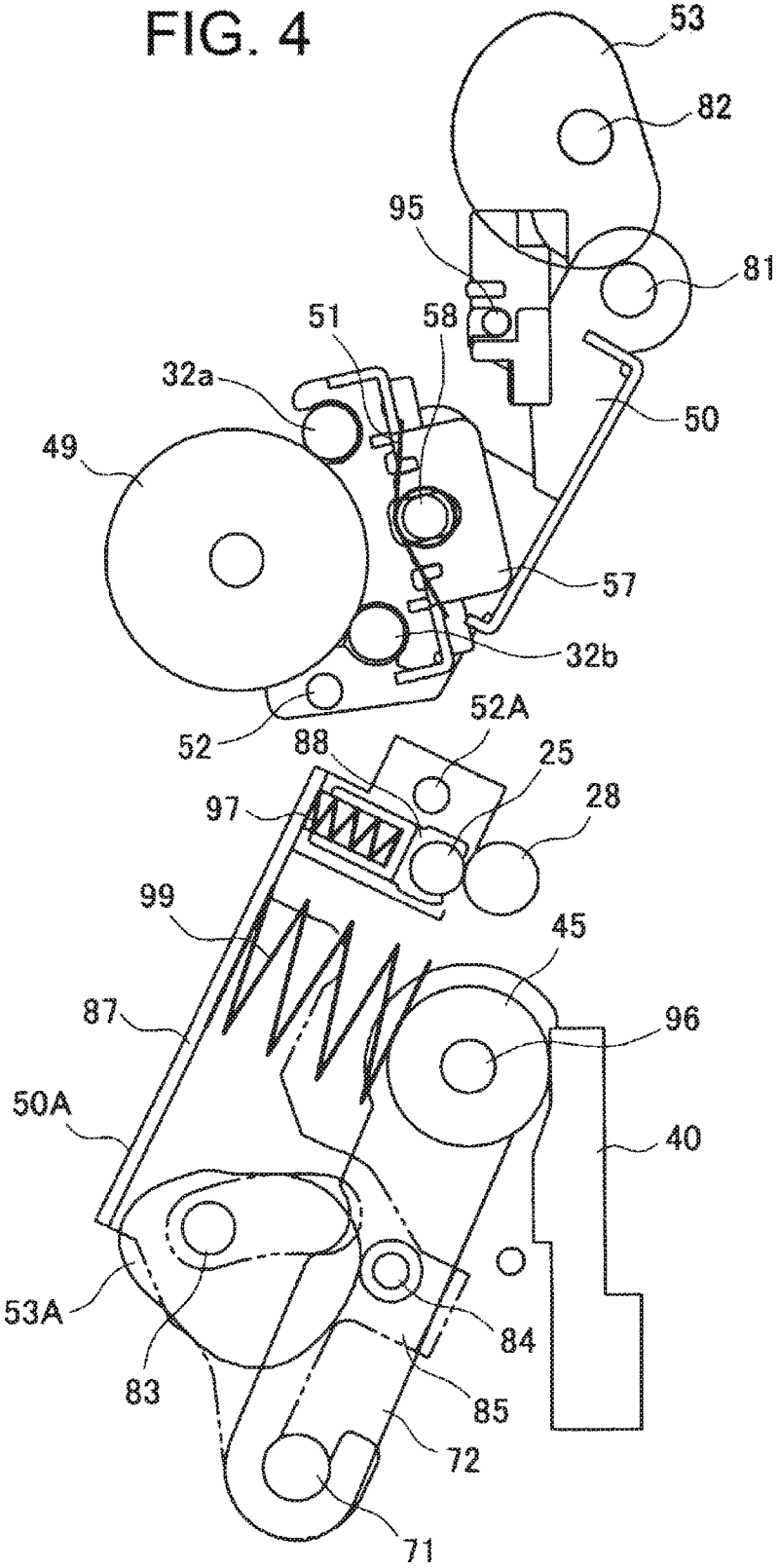
FIG. 4 is a view for explaining a control state using the cams at a printing position where the pinch rollers and film conveying roller are brought into contact with each other, and the platen roller and thermal head are brought into contact with each other.
Figure 5:
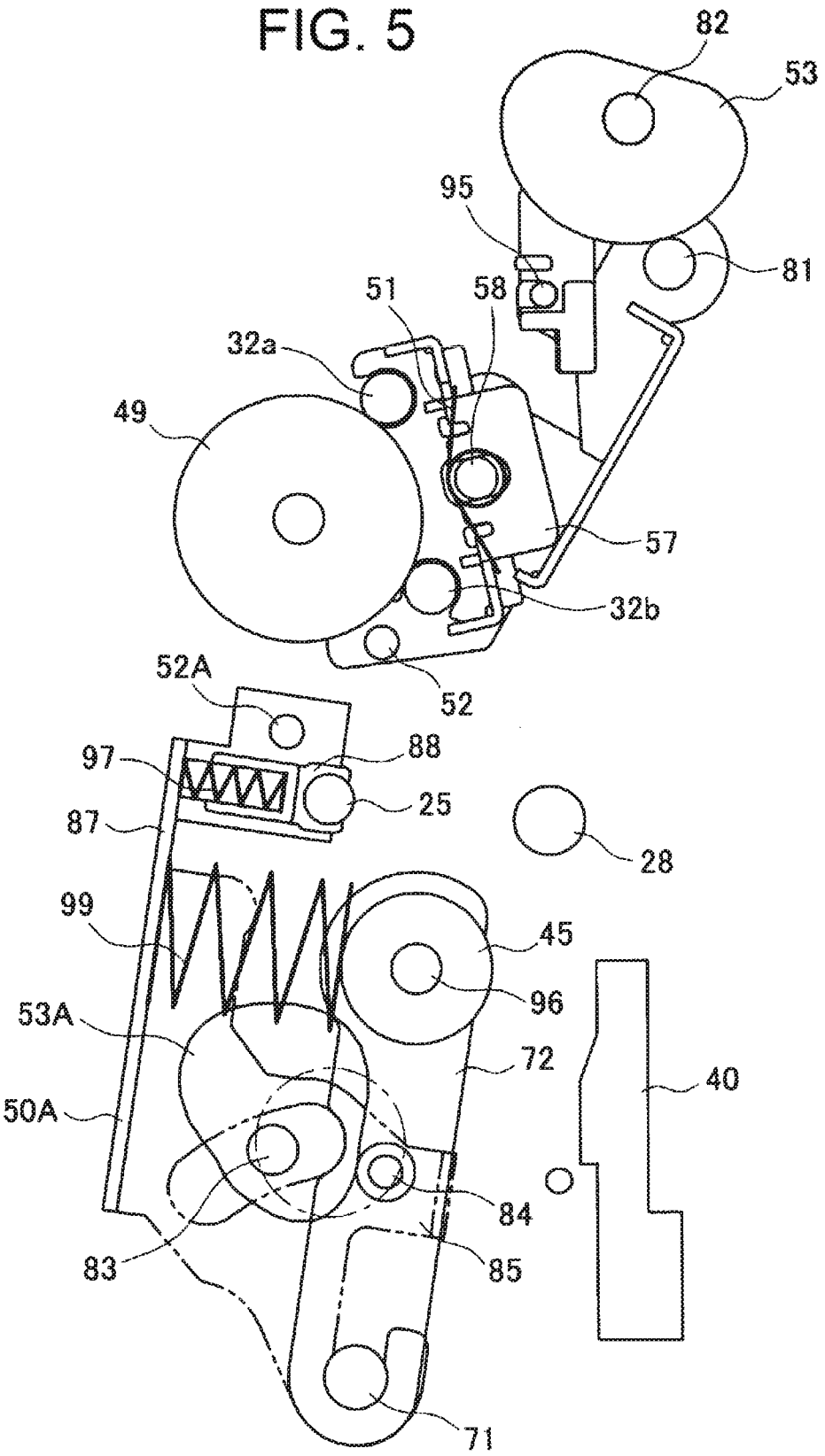
FIG. 5 is a view for explaining a control state using the cams at a conveying position where the pinch rollers and film conveying roller are brought into contact with each other, and the platen roller and thermal head are brought into contact with each other.
Figure 10:
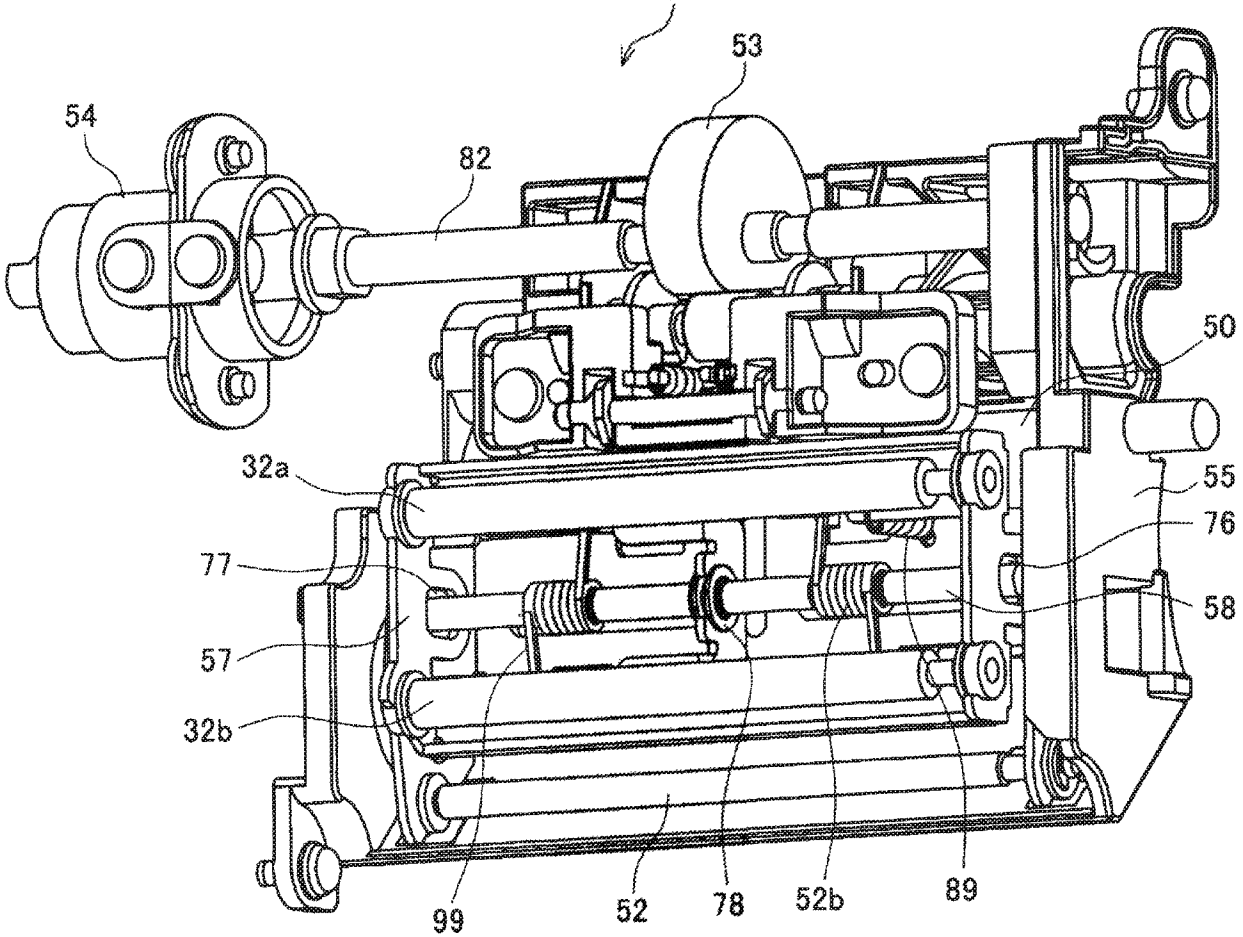
FIG. 10 is an outer appearance view illustrating the configuration of a second unit in which the pinch rollers and their peripheral components are integrated for installation to the printer.

Details of the configuration of the image forming section B1 will be described. As illustrated in FIGS. 3 to 5, the pinch rollers 32*a* and 32*b* are supported respectively by an upper end portion and a lower end portion of a pinch roller support member 57, and the pinch roller support member 57 is rotatably supported by a support shaft 58 penetrating the center portion of the member 57. As illustrated in FIG. 10, the support shaft 58 is laid at its opposite end portions between long holes 76 and 77 formed in the pinch roller support member 57 and is fixed at its center portion to a fixing part 78 of a bracket 50. Further, the long holes 76 and 77 are provided with spaces in the horizontal direction and vertical direction with respect to the support shaft 58. This allows adjustment of the positions of the pinch rollers 32*a* and 32*b* with respect to the film conveying roller 49, the details of which will be described later.

Spring members 51 (51*a*, 51*b*) are mounted on the support shaft 58, and end portions of the pinch roller support member 57 on which the pinch rollers 32*a* and 32*b* are installed each contact the spring members 51 and are biased to the direction of the film conveying roller 49 by the spring force of the spring members 51.

The bracket 50 comes into contact with the cam operation surface of a cam 53 at a cam receiver 81 and is configured to be moved in the horizontal direction with respect to the film conveying roller 49 in the figure in accordance with rotation of the cam 53 in the arrow direction with a cam shaft 82 rotated by drive force of a drive motor 54 (see FIG. 10) as a rotation axis. Accordingly, when the bracket 50 advances toward the film conveying roller 49 (FIGS. 4 and 5), the pinch rollers 32*a* and 32*b* come into pressure-contact with the film conveying roller 49 against the biasing force of the spring members 51 with the transfer film 46 nipped therebetween and wind the transfer film 46 around the film conveying roller 49.

At this point, the pinch roller 32*b* in a farther position from a shaft 95 as a rotation axis of the bracket 50 first comes into pressure-contact with the film conveying roller 49, and then, the pinch roller 32*a* comes into pressure-contact with the same. In this way, by arranging the shaft 95 that is the rotation axis above the film conveying roller 49, the pinch roller support member 57 comes into contact with the film conveying roller 49 while being rotated, instead of parallel shift, which advantageously reduces a space in the width direction as compared with a case where the pinch roller support member 57 is parallelly shifted.

Further, the pressure-contact force when the pinch rollers 32*a* and 32*b* come into pressure-contact with the film conveying roller 49 is uniform in the width direction of the transfer film 46 by the spring members 51. At this point, the long holes 76 and 77 are formed on both sides of the pinch roller support member 57, and the support shaft 58 is fixed to the fixing part 78, so that it is possible to adjust the pinch roller support member 57 in three directions, and the transfer film 46 is conveyed in a correct posture by rotation of the film conveying roller 49 without causing skew. The adjustments in three directions mentioned herein include (i) adjusting the degree of parallelization of the shafts of the pinch rollers 32*a* and 32*b* with respect to the shaft of the film conveying roller 49 in the horizontal direction to uniform the pressure-contact force of the pinch rollers 32*a* and 32*b* in the shaft direction with respect to the film conveying roller 49, (ii) adjusting the moving distances of the pinch rollers 32*a* and 32*b* with respect to the film conveying roller 49 to uniform the pressure-contact force of the pinch roller 32*a* against the film conveying roller 49 and the pressure-contact force of the pinch roller 32*b* against the film conveying roller 49, and (iii) adjusting the degree of parallelization of the shafts of the pinch rollers 32*a* and 32*b* in the vertical direction with respect to the shaft of the film conveying roller 49 so that the shafts of the pinch rollers 32*a* and 32*b* are perpendicular to the film travel direction.

Further, the bracket 50 is provided with a tension receiving member 52 that comes into contact with a part of the transfer film 46 that is not wound around the film conveying roller 49 when the bracket 50 advances toward the film conveying roller 49.

The tension receiving member 52 is provided to prevent the pinch rollers 32*a* and 32*b* from retracting from the film conveying roller 49 against the biasing force of the spring members 51 due to the tension of the transfer film 46 caused when the pinch rollers 32*a* and 32*b* bring the transfer film 46 into pressure-contact with the film conveying roller 49. Accordingly, the tension receiving member 52 is attached to the front end of the rotation side end portion of the bracket 50 so as to come into contact with the transfer film 46 at the position to the left of the pinch rollers 32*a* and 32*b* in the figure. FIG. 2 illustrates a state where the tension receiving member 52 is brought into contact with the transfer film 46.

As a result, the cam 53 is capable of directly receiving the tension caused due to elasticity of the transfer film 46 through the tension receiving member 52. This prevents the pinch rollers 32*a* and 32*b* from retracting from the film conveying roller 49 due to the tension to prevent the pressure-contact force of the pinch rollers 32*a* and 32*b* from decreasing, thereby maintaining the winding state in which the transfer film 46 is brought into intimate contact with the film conveying roller 49, which allows accurate conveyance to be performed.

Figure 9:
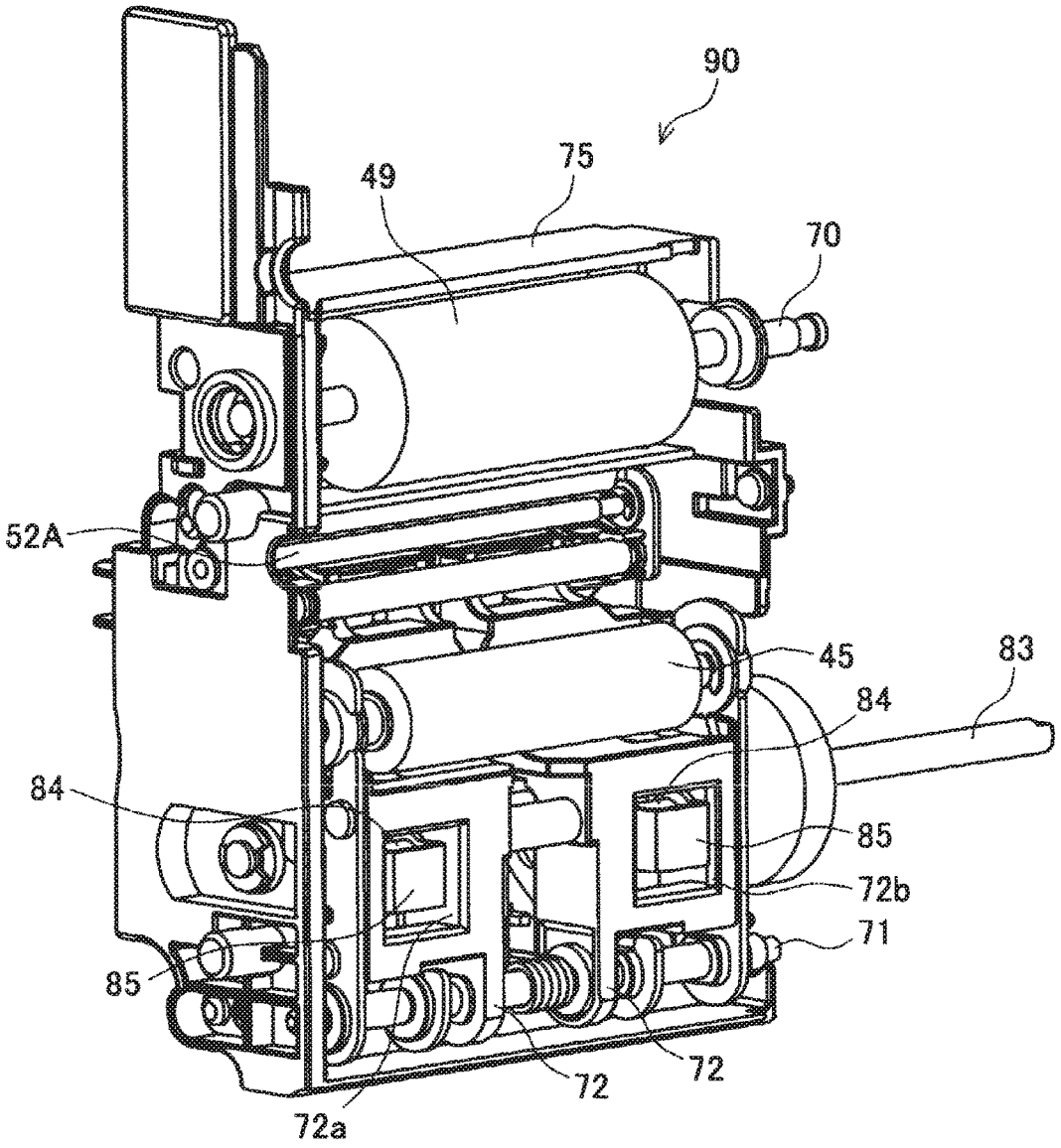
FIG. 9 is an outer appearance view illustrating the configuration of a first unit in which the film conveying roller, platen roller, and their peripheral components are integrated for installation to the printer.

As illustrated in FIG. 9, the platen roller 45 disposed along the transverse width direction of the transfer film 46 is supported by a pair of platen support members 72 rotatable about a shaft 71 as a rotation axis. The pair of platen support members 72 support both ends of the platen roller 45. The platen support members 72 are connected respectively to end portions of a bracket 50A having the shaft 71 as a common rotating shaft through spring members 99.

The bracket 50A has a substrate 87 and a cam receiver support part 85 formed by bending the substrate 87 in the direction of the platen support member 72, and the cam receiver support part 85 holds a cam receiver 84. A cam 53A rotated on a cam shaft 83 as a rotation axis driven by the drive motor 54 is disposed between the substrate 87 and the cam receiver support part 85 and is configured so that the cam operation surface thereof and the cam receiver 84 come into contact with each other. Accordingly, when the bracket 50A advances in the direction of the thermal head 40 by rotation of the cam 53A, the platen support members 72 are also moved to bring the platen roller 45 into pressure-contact with the thermal head 40.

By thus disposing the spring members 99 and cam 53A vertically between the bracket 50A and the platen support members 72, it is possible to store a platen moving unit within the distance between the bracket 50A and the platen support members 72, and the width direction thereof is held within the width of the platen roller 45, thereby allowing space saving.

Further, the cam receiver support part 85 is fitted into bore parts 72*a* and 72*b* (see FIG. 9) formed in the platen support members 72, so that even when the cam receiver support part 85 is formed so as to protrude in the direction of the platen support members 72, the distance between the bracket 50A and the platen support members 72 is not increased. Thus, also in this respect, space saving can be achieved.

When the platen roller 45 comes into pressure-contact with the thermal head 40, the spring members 99 connected to the respective platen support members 72 each act so as to uniform the pressure-contact force against the width direction of the transfer film 46. Therefore, when the transfer film 46 is conveyed by the film conveying roller 49, the skew is prevented, and thus it is possible to accurately perform image formation on the transfer film 46 by the thermal head 40 without causing a shift of the image formation region R on the transfer film 46 in the width direction.

The substrate 87 of the bracket 50A is provided with a pair of peeling roller support members 88 for supporting opposite ends of the peeling roller 25 through spring members 97, and when the bracket 50A advances to the thermal head 40 by rotation of the cam 53A, the peeling roller 25 comes into contact with the peeling member 28 to peel off the transfer film 46 and ink ribbon 41 nipped therebetween. The peeling roller support members 88 are also provided respectively at opposite ends of the peeling roller 25 as in the platen support members 72, and are configured so as to uniform the pressure-contact force against the width direction on the peeling member 28.

A tension receiving member 52A is provided in the end portion on the side opposite to the end portion on the shaft support 59 side of the bracket 50A. The tension receiving member 52A is provided to absorb the tension of the transfer film 46 caused in bringing the platen roller 45 and peeling roller 25 into pressure-contact with the thermal head 40 and peeling member 28, respectively. The spring members 99 and 97 are provided so as to uniform the pressure-contact force against the width direction of the transfer film 46, and, conversely, in order for the spring members 99 and 97 not to fall behind the tension of the transfer film 46 and decrease the pressure-contact force against the transfer film 46, the tension receiving member 52A receives the tension from the transfer film 46. Since the tension receiving member 52A is also fixed to the bracket 50A as in the above-mentioned tension receiving member 52, the cam 53A receives the tension of the transfer film 46 through the bracket 50A, and thus the tension receiving member 52A by no means falls behind the tension of the transfer film 46. With this configuration, the pressure-contact force between the thermal head 40 and the platen roller 45 and the pressure-contact force between the peeling member 28 and the peeling roller 25 are maintained, and it is thereby possible to perform excellent image formation and peeling. Further, any error does not occur in the conveying amount of the transfer film 46 at the driving of the film conveying roller 49, the transfer film 46 corresponding to the length of the image formation region R is accurately conveyed to the thermal head 40, and it is possible to perform image formation with accuracy (without color shift).

The cam 53 and cam 53A are driven by the same drive motor 54 with a belt 98 (see FIG. 3) stretched therebetween.

(6-4) Waiting Position, Conveying Position, Printing Position

Figure 6:
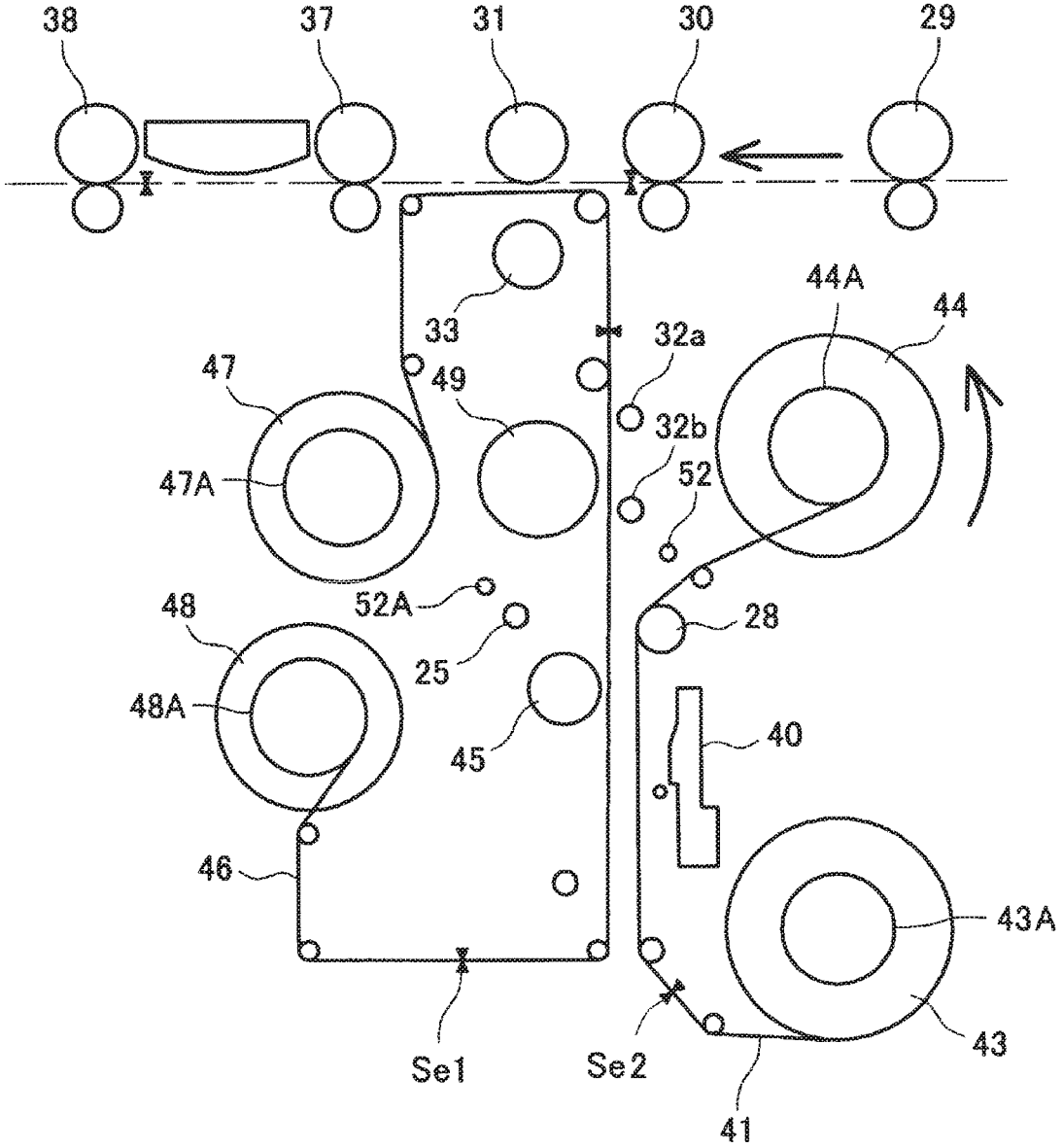
FIG. 6 is an operation explanatory view for explaining a state of the printer at the waiting position.

When the printing section B is at a waiting position as illustrated in FIG. 6, the cam 53 and cam 53A are in the state as illustrated in FIG. 3. In this state, the pinch rollers 32*a* and 32*b* are not brought into pressure-contact with the film conveying roller 49, and the platen roller 45 is not brought into pressure-contact with the thermal head 40 either. In other words, at the waiting position, the platen roller 45 and thermal head 40 are positioned in separate positions at which the roller 45 and head 40 are separated from each other.

Figure 7:
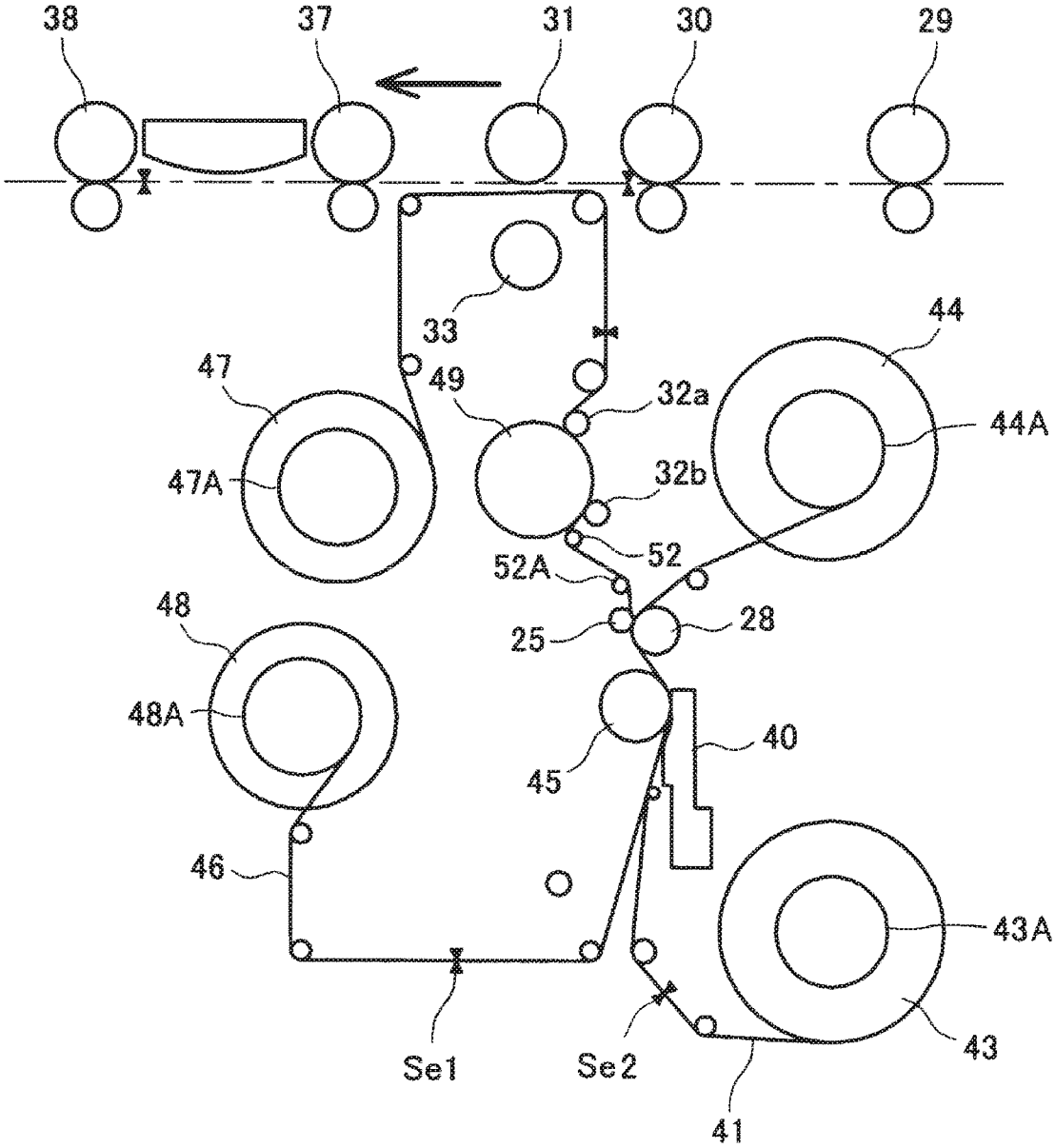
FIG. 7 is an operation explanatory view for explaining a state of the printer at the conveying position.

Then, when the cam 53 and cam 53A are rotated in conjunction with each other and are in the state as illustrated in FIG. 4, the printing section B shifts to a printing position as illustrated in FIG. 7. At this point, the pinch rollers 32*a* and 32*b* first wind the transfer film 46 around the film conveying roller 49, and the tension receiving member 52 comes into contact with the transfer film 46. Subsequently, the platen roller 45 comes into pressure-contact with the thermal head 40. At this printing position, the platen roller 45 is moved toward the thermal head 40 to nip the transfer film 46 and ink ribbon 41 therebetween and come into press-contact with the thermal head 40, and the peeling roller 25 is in contact with the peeling member 28.

In this state, at the same time when conveyance of the transfer film 46 is started by rotation of the film conveying roller 49, the ink ribbon 41 is wound around the winding roll 44 by operation of the motor Mr1 and conveyed in the same direction. During this conveyance, the mark formed on the transfer film 46 passes through the sensor Se1 and is moved a predetermined amount, and at the time when the transfer film 46 arrives at the image formation start position, image formation by the thermal head 40 is started in the image formation region R on the transfer film 46.

Particularly, the tension of the transfer film 46 is large during image formation, so that the tension of the transfer film 46 acts on the direction that separates the pinch rollers 32*a* and 32*b* from the film conveying roller 49 and the direction that separates the peeling roller 25 and the platen roller 45 from the peeling member 28 and the thermal head 40, respectively. However, as described above, the tension of the transfer film 46 is received by the tension receiving members 52 and 52A, the pressure-contact force of the pinch rollers 32*a* and 32*b* is not decreased, so that it is possible to perform accurate film conveyance. Further, the pressure-contact force between the thermal head 40 and the platen roller 45 and the pressure-contract force between the peeling member 28 and the peeling roller 25 are not decreased either, so that it is possible to perform accurate image formation (printing) and peeling.

The conveying amount of the transfer film 46 i.e. the conveying distance of the transfer film 46 in the conveying direction is detected by an unillustrated encoder (hereinafter, referred to as "encoder of the film conveying roller 49") provided in the film conveying roller 49. Based on the detection, rotation of the film conveying roller 49 is stopped, and at the same time, winding by the winding roll 44 by operation of the motor Mr1 is also stopped. As a result, image formation with ink of the first ink panel onto the image formation region R on the transfer film 46 is finished.

Figure 8:
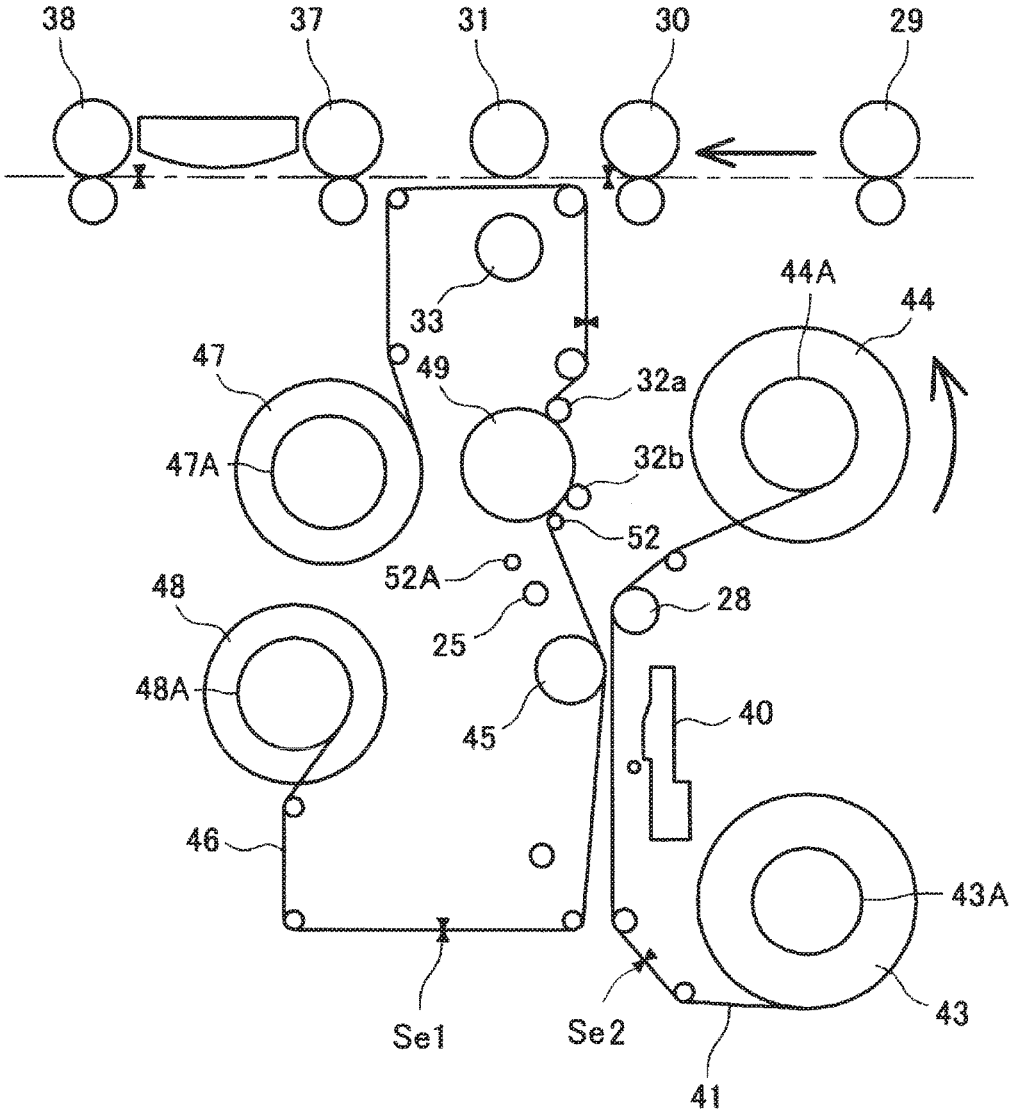
FIG. 8 is an operation explanatory view for explaining a state of the printer at the printing position.

Next, when the cam 53 and cam 53A are further rotated in conjunction with each other and are in the state as illustrated in FIG. 5, the printing section B shifts to a conveying position as illustrated in FIG. 8, and the platen roller 45 returns to the direction in which it retracts from the thermal head 40. In this state, the pinch rollers 32*a* and 32*b* still wind the transfer film 46 around the film conveying roller 49, the tension receiving member 52 is in contact with the transfer film 46, and the transfer film 46 is conveyed backward to its initial position by rotation of the film conveying roller 49 in the backward direction. Also at this point, the moving amount of the transfer film 46 is controlled by the rotation of the film conveying roller 49, and the transfer film 46 is conveyed backward by a length corresponding to the length of the image formation region R in the conveying direction in which an image is formed by the ink panel of one color (e.g., Y). The ink ribbon 41 is also rewound a predetermined amount by the motor Mr3, and the ink panel of the ink to print the next image is made to wait in the initial position (cueing position).

Then, the cam 53 and cam 53A shifts to a state as illustrated in FIG. 4 again, and the printing section B shifts to the printing position as illustrated in FIG. 7. In this state, the platen roller 45 is brought into pressure-contact with the thermal head 40, the film conveying roller 49 is rotated in the forward direction again to move the transfer film 46 by a length corresponding to the image formation region R, and image formation with the ink of the next ink panel is performed by the thermal head 40.

Thus, the operations at the printing position and at the conveying position are repeated until image formation with ink of all or predetermined ink panel is finished. Then, when image formation by the thermal head 40 is finished, the image formation region R on the transfer film 46 is conveyed to the heat roller 33, and at this point, the cam 53 and cam 53A are made to shift to the state as illustrated in FIG. 3, and pressure-contact between the cams 53, 53A and the transfer film 46 is released. Subsequently, transfer of the image onto the card Ca is performed while conveying the transfer film 46 by the driving of the film conveying motor Mr5 (and motors Mr2 and Mr4).

(6-5) Three Units of Printing Section B

The thus configured printing section B is divided into three units 90, 91, and 92.

As illustrated in FIG. 9, in the first unit 90, a unit frame body 75 is installed with a drive shaft 70 that is rotated by the driving of the drive motor 54 (see FIG. 10), and the film conveying roller 49 is inserted with the drive shaft 70. Below the film conveying roller 49, the bracket 50A and the pair of platen support members 72 are disposed, and these members are rotatably supported by the shaft 71 laid between opposite side plates of the unit frame body 75.

In FIG. 9, the pair of cam receiver support parts 85 that are a part of the bracket 50A appear from the bore parts 72*a* and 72*b* formed in the platen support members 72. The cam receiver support parts 85 hold the pair of cam receivers 84 disposed at the back thereof. At the back of the cam receivers 84, the cam 53A installed in the cam shaft 83 inserted through the unit frame body 75 is disposed. The cam shaft 83 is laid between the opposite side plates of the unit frame body 75.

Figure 11:
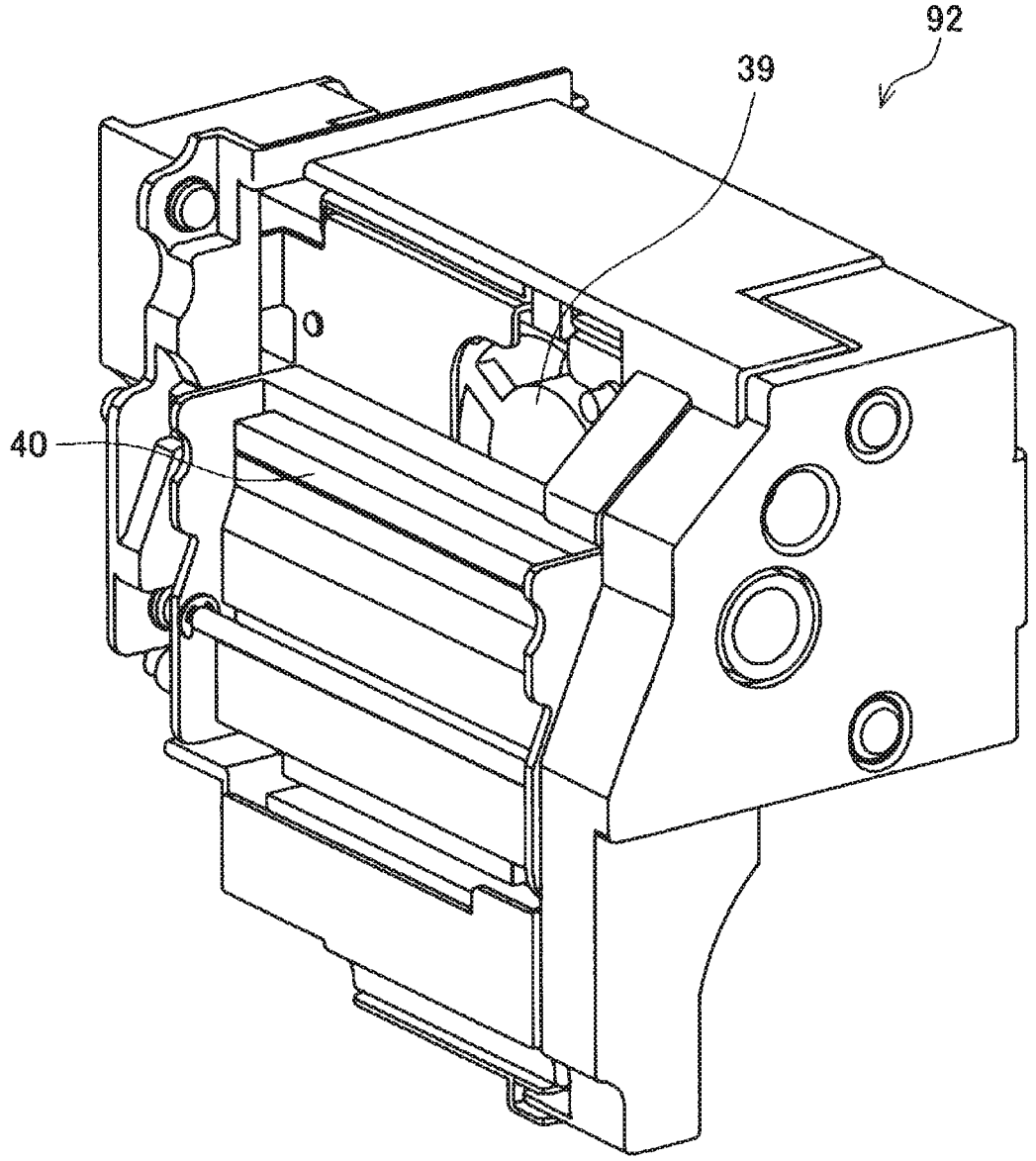
FIG. 11 is an outer appearance view illustrating the configuration of a third unit in which the thermal head is integrated for installation to the printer.

The above-mentioned thermal head 40 is disposed at the position opposed to the platen roller 45 with a conveying path of the transfer film 46 and ink ribbon 41 interposed therebetween. The thermal head 40, members related to heating, and cooling fan 39 are integrated into the third unit 92 as illustrated in FIG. 11 and are disposed opposite to the first unit 90.

The first unit 90 collectively holds the platen roller 45, peeling roller 25, and tension receiving member 52A varied in position by image forming operation by the movable bracket 50A, thereby eliminating the need of position adjustment among these members. Further, by moving the bracket 50A by rotation of the cam 53, it is possible to move these members to predetermined positions. Further, since the bracket 50A is provided, it is possible to store these members in the same unit as that of the fixed film conveying roller 49. Thus, a conveying drive portion by the film conveying roller 49 required to convey the transfer film 46 with accuracy and a transfer position regulation portion by the platen roller 45 are included in the same unit, thereby eliminating the need of position adjustment between both portions.

As illustrated in FIG. 10, in the second unit 91, the cam shaft 82 installed with the cam 53 is inserted through a unit frame body 55 and is connected to the output shaft of the drive motor 54. The second unit 91 movably supports the bracket 50 in the unit frame body 55 to bring the bracket 50 into contact with the cam 53, and the support shaft 58 that rotatably supports the pinch roller support member 57 and the tension receiving member 52 are fixed to the bracket 50.

In the pinch roller support member 57, the spring members 51*a* and 51*b* are attached to the support shaft 58, and end portions of the support shaft 58 are brought into contact with the respective opposite ends of the pinch roller support member 57 that supports the pinch rollers 32*a* and 32*b* to bias the pinch roller support member 57 toward the film conveying roller 49. In the pinch roller support member 57, the support shaft 58 is inserted in the long holes 76 and 77 and is fixed and supported at its center portion by the bracket 50.

A spring 89 for biasing the pinch roller support member 57 toward the bracket 50 is provided between the bracket 50 and the pinch roller support member 57. By this spring 89, the pinch roller support member 57 is biased in the direction in which it retracts from the film conveying roller 49 of the first unit 90, and therefore, it is possible to easily pass the transfer film 46 through between the first unit 90 and the second unit 91 in setting the transfer film cassette in the printer 1.

The second unit 91 holds the pinch rollers 32*a* and 32*b* and tension receiving member 52 varied in position in accordance with image formation operation at the bracket 50A and moves the pinch rollers 32*a* and 32*b* and tension receiving member 52 by moving the bracket 50A by rotation of the cam 53, thereby simplifying position adjustment between the rollers and the member and position adjustment between the pinch rollers 32*a* and 32*b* and the film conveying roller 49. The thus configured second unit 91 is disposed opposite to the first unit 90 with the transfer film 46 interposed therebetween.

By thus dividing the printing section B, it is also possible to pull the first unit 90, second unit 91 and third unit 92 independently out of the main body of the printer 1 as in the cassettes of the transfer film 46 and ink ribbon 41. Accordingly, when the units 90, 91 and 92 are pulled out as required in replacing the cassette due to consumption of the transfer film 46 or ink ribbon 41, it is possible to install the transfer film 46 or ink ribbon 41 readily inside the printer 1 in inserting the cassette.

As described above, by combining the first unit 90 into which the platen roller 45, bracket 50A, cam 53A, and platen support member 72 are integrated and the second unit 91 into which the pinch rollers 32*a* and 32*b*, bracket 50, cam 53, and spring members 51 are integrated, and placing and installing the third unit 92 with the thermal head 40 attached thereto opposite to the platen roller 45, it is possible to perform assembly in manufacturing the printer 1 and adjustment in maintenance with ease and accuracy. Further, by integrating the members constituting each unit, it is possible to perform removal from the printer 1 with ease, whereby handleability of the printer is improved.

1-2-2. Control Section and Power Supply Section

Next, a control section and a power supply section of the printer 1 will be described. As illustrated in FIG. 15, the printer 1 has a control section 100 that performs operation control of the entire printer 1 and a power supply section 120 that converts a commercial AC power supply into a DC power supply that enables each mechanism section, control section, and the like to be driven and actuated.

(1) Control Section

As shown in FIG. 15, the control section 100 is provided with a microcomputer unit (MCU) 102 (hereinafter, abbreviated as "MCU 102") that performs entire control processing of the printer 1. The MCU 102 includes a CPU that operates at high-speed clock as a central processing unit, a ROM that stores therein a program and program data of the printer 1, a RAM that works as a work area of the CPU, and an internal bus that connects the above components.

The MCU 102 is connected with an external bus. The external bus is connected with a communication section 101 that has a communication IC and communicates with the host device 201 and a memory 107 that temporarily stores therein printing data to print an image on the card Ca and recording data to be magnetically or electrically recorded in a magnetic stripe or stored IC of the card Ca.

Further, the external bus is connected with a signal processing section 103 that processes signals from various sensors se1 to se3, film conveying motor Mr5, and encoders of the respective motors Mr1 to Mr4, an actuator control section 104 that includes a motor driver and the like that supplies drive pulses and drive power to each motor, a thermal head control section 105 that controls thermal energy to the heating elements constituting the thermal head 40, an operation display control section 106 that controls the operation panel section 5, and the above-mentioned information recording section A.

The actuator control section 104 includes motor drivers for driving the motors Mr1 to Mr4. The motor drivers each have a timer IC that generates a pulse train to enable duty ratio (ratio of ON and OFF of supply current) to be changed. Assuming that a period of a switching frequency is T and energizing time is t, the duty ratio is expressed by $\{(T-t/T)\}\times100(\%)$. The motors Mr1 to Mr4 are driven by PWM (Pulse Width Modulation) pulses generated in the timer IC. In addition, in order to suppress noise while enhancing energy efficiency, flywheel diodes (not illustrated) are connected in parallel to the motors Mr1 to Mr4, respectively. While the motor driver performs temperature correction of the PWM pulses according to ambient temperature detected by the temperature sensor Th, detail description thereof is omitted in the present embodiment.

The MCU 102 instructs the duty ratio of each of the motors Mr1 to Mr4 to the actuator control section 104, and the actuator control section 104 drives the motors Mr1 to Mr4 at the duty ratio instructed to the timer IC of each of the motor drivers.

(2) Power Supply Section

The power supply section 120 supplies operation/drive power to the control section 100, thermal head 40, heat roller 33, operation panel section 5, information recording section A, and the like.

2. Technical Background and Characteristics of Printer 1

Next, technical background and characteristics of the printer 1 according to the present embodiment will be described.

2-1. Background of Printer 1

As described in the above sections 1-2-1 (6)(6-1), the feeding and winding spools 47A and 48A for the transfer film 46 and the feeding and winding spools 43A and 44A for the ink ribbon 41 are disposed opposite to each other on the upstream and downstream sides of the image forming section B1. The feeding spool 47A is rotated by drive force of the motor Mr2, the winding spool 48A is rotated by drive force of the motor Mr4, the feeding spool 43A is rotated by drive force of the motor Mr3, and the winding spool 44A is rotated by drive force of the motor Mr1. DC motors are used for the motors Mr1 to Mr4. The transfer film 46 is conveyed by drive force of the film conveying motor Mr5 (stepping motor).

(1) Related Art

As in the related art, in the printer 1, the drive amounts (duty ratios) of the motors Mr1 to Mr4 are corrected so as to maintain the tensions of the transfer film 46 and ink ribbon 41 constant at image formation even when the diameters of the rolls wound around the respective spools, i.e., the diameters of the respective winding and feeding rolls 48 and 47 for the transfer film 46, and the diameters of the respective feeding and winding rolls 43 and 44 for the ink ribbon 41 are varied.

Figure 16A:
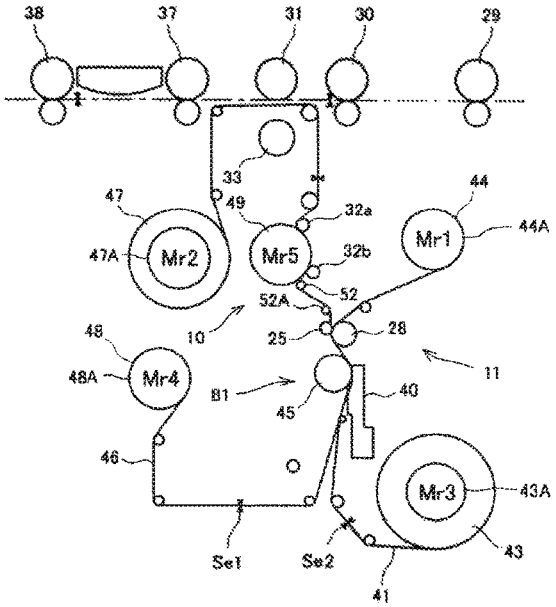
Figure 17A:
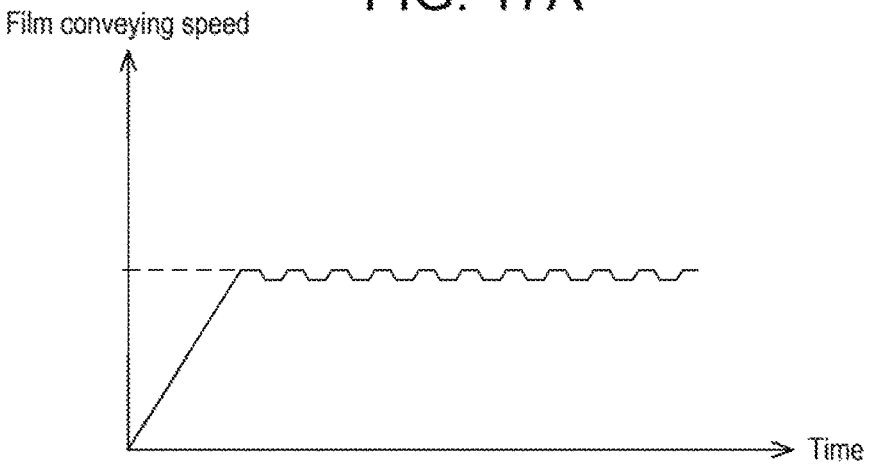

For example, when the diameter of the winding roll 48 wound around the winding spool 48A for the transfer film 46 is small (for example, as illustrated in FIG. 16A, in a state in which the transfer film 46 is new where a used part of the transfer film 46 is not wound around the winding spool 48A while an unused part of the transfer film 46 is wound around the feeding spool 47A), the duty ratio is controlled so as to increase the rotation speed of the motor Mr4. When the rotation speed of the motor Mr4 is high, uneven gradation in a printed image (hereinafter, referred to as "pitch unevenness") is inconspicuous even when rotation unevenness occurs in the motor Mr4 (see FIG. 17A).

(2) Problem 1

Figure 16B:
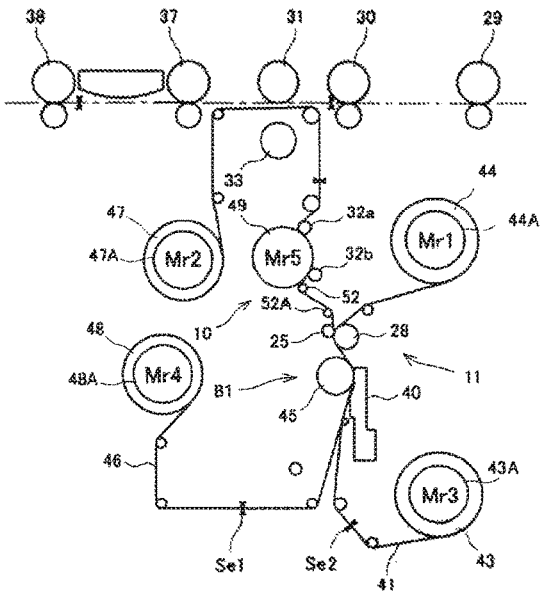
Figure 16C:
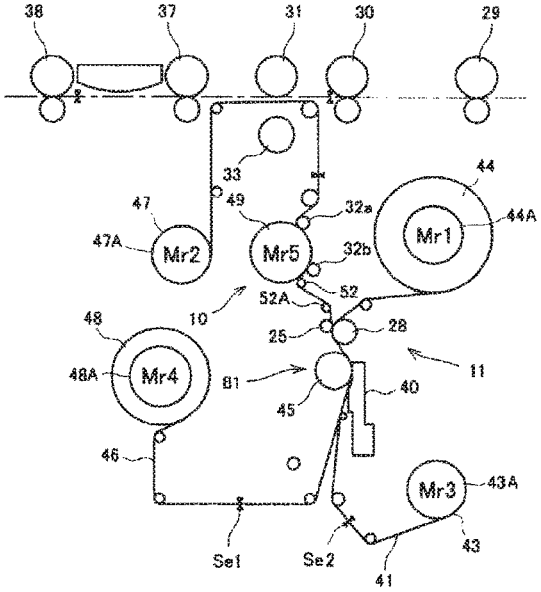

On the other hand, when the diameter of the winding roll 48 wound around the winding spool 48A for the transfer film 46 is large (for example, as illustrated in FIG. 16C, in a state in which the transfer film 46 is empty where most of the used part of the transfer film 46 is wound around the winding spool 48A while there is little unused part of the transfer film 46 on the feeding spool 47A), the duty ratio is controlled so as to decrease the rotation speed of the motor Mr4. When the rotation speed of the motor Mr4 is low, a period of the rotation unevenness is widened, so that when a predetermined back tension is applied to the transfer film 46 in this state, the pitch unevenness becomes conspicuous.

Figure 17B:
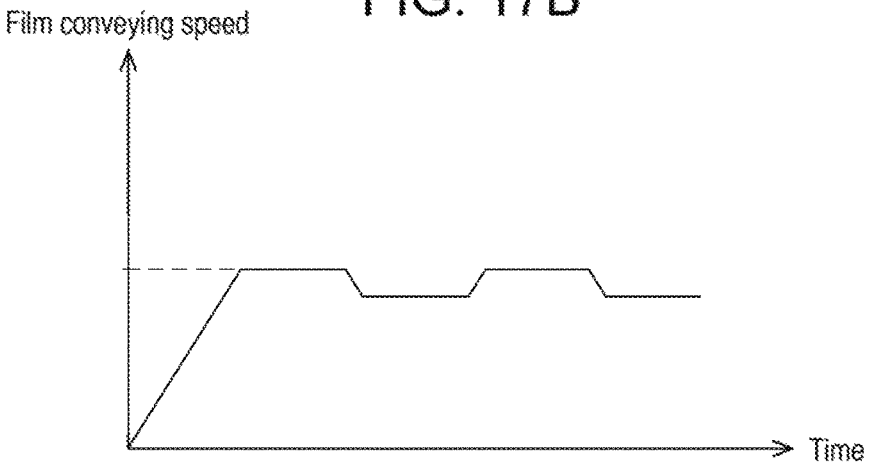
Figure 18:
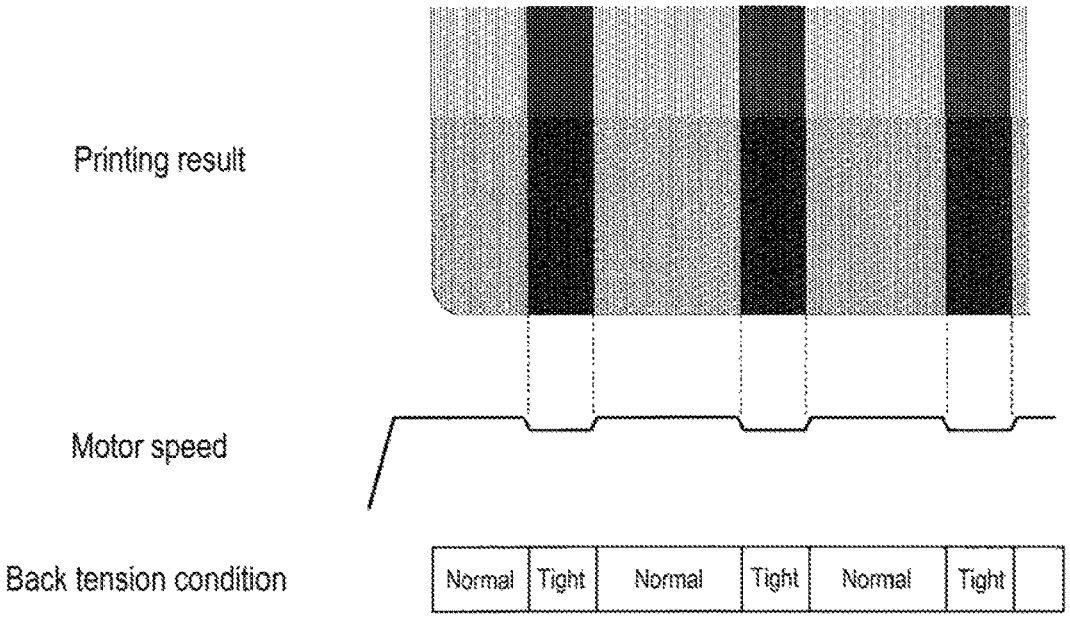
FIG. 18 is an explanatory view schematically illustrating the relationship among a back tension, a motor speed (rotation speed), and a printing result.

This state is schematically illustrated in FIG. 17B and FIG. 18. As illustrated in FIG. 17B, in a case where the rotation speed of the motor Mr4 is low and the back tension to the transfer film 46 is high, the conveying speed of the transfer film 46 is decreased due to back tension force with respect to the transfer film 46 due to the rotation unevenness of the motor Mr4 (that is, when a tension force is suddenly applied to the transfer film 46, the conveying speed of the transfer film 46 is decreased). As a result, as illustrated in FIG. 18, a printed image on a part to which the tension force is applied becomes dark (pitch unevenness is conspicuous).

Figure 17C:
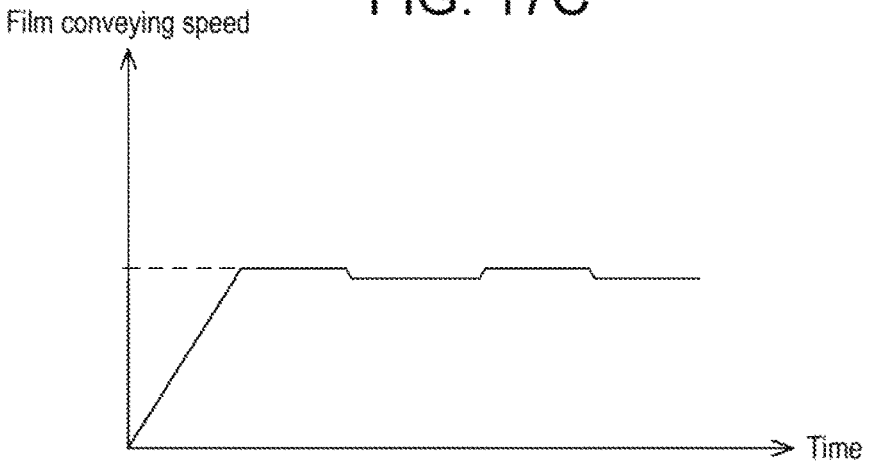

Such pitch unevenness is gradation appearing irrelevant to printing data and may thus cause degradation in printing quality. To solve this problem, by adjusting the drive amount of the motor Mr4 to reduce the back tension to be applied to the transfer film 46, the pitch gradation becomes inconspicuous. FIG. 17C illustrates a case where the duty ratio of the motor Mr4 is increased to reduce the back tension to be applied to the transfer film 46. As can be seen from a comparison with FIG. 17B, by reducing the back tension, the drop amount of the conveying speed of the transfer film 46 due to the tension force with respect to the transfer film 46 is reduced, whereby the pitch unevenness becomes inconspicuous.

FIG. 16B illustrates an intermediate state of the transfer film 46 (and ink ribbon 41), i.e., a state where the transfer film 46 (and ink ribbon 41) is in an intermediate position between winding start and winding end. Even in this state, the back tension with respect to the transfer film 46 (and ink ribbon 41) is maintained at a predetermined value during image formation by the image forming section B1.

(3) Problem 2

As described above, even when rotation unevenness occurs in the motor Mr4, the pitch unevenness becomes inconspicuous (degradation in printing quality can be prevented) by adjusting the drive amount of the motor Mr4 (increasing the duty ratio of the motor Mr4) to reduce the back tension to be applied to the transfer film 46. However, the transfer film 46 and ink ribbon 41 are conveyed at the same speed and in the same direction at image formation, so that when the back tension with respect to the transfer film 46 is excessively reduced, the transfer film 46 may excessively advance due to the tension force of the motor Mr1 that drives the winding spool 44A for the ink ribbon 41 (hereinafter, this phenomenon is referred to as "slippage"). Such slippage may produce an image missing part (image skipping) on the transfer film 46, which may degrade printing quality as the pitch unevenness does.

The above pitch unevenness and slippage occurring on the transfer film 46 side may occur on the ink ribbon 41 side. For example, the rotation speed of the motor Mr3 is low in the state illustrated in FIG. 16A where the ink ribbon 41 is new, so that pitch unevenness may occur due to the lower rotation speed. This pitch unevenness also becomes inconspicuous by adjusting the drive amount of the motor Mr3 (increasing the duty ratio of the motor Mr3) to reduce the back tension to be applied to the ink ribbon 41. However, when the back tension with respect to the ink ribbon 41 is excessively reduced, the slippage occurs in the ink ribbon 41 due to the tension force of the film conveying motor Mr5 that drives the film conveying roller 49, which may degrade printing quality.

2-2. Characteristics of Printer 1

The printer 1 is characterized by solving degradation in printing quality due to the problem 1 (pitch unevenness) and problem 2 (slippage) so as to form a high quality image on the transfer film 46 (and then on the card Ca).

That is, (i) as for the problem 1, the duty ratio of the motor Mr4 (when the back tension with respect to the transfer film 46 is high, see FIG. 16C) or the motor Mr3 (when the back tension with respect to the ink ribbon 41 is high, see FIG. 16A) is increased to reduce the back tension to be applied to the transfer film 46 or ink ribbon 41, (ii) as for the problem 2, (a) when the back tension with respect to the transfer film 46 is excessively reduced as a result of an increase in the duty ratio of the motor Mr4, the duty ratio of the motor Mr3 that drives the opposite side spool (feeding spool 43A for the ink ribbon 41) is reduced to increase the back tension with respect to the ink ribbon 41 so as to prevent the slippage, (b) when the back tension with respect to the ink ribbon 41 is excessively reduced as a result of an increase in the duty ratio of the motor Mr3, the duty ratio of the motor Mr4 that drives the opposite side spool (winding spool 48A for the transfer film 46) is reduced to increase the back tension with respect to the transfer film 46 so as to prevent the slippage.

Hereinafter, the characteristics of the printer 1 will be described in terms of (1) detection of rotation speed, (2) calculation of drive amount, (3) drive amount adjustment for one motor (first drive source), (4) drive amount adjustment for the other motor (second drive source), and (5) storage of drive amount in this order. The above (1) to (5) are collectively referred to as "drive amount determination processing".

(1) Detection of Rotation Speed

First, the rotation speeds of the respective motors Mr1 to Mr4 are detected on the assumption that the drive amount (duty ratio) is adjusted. The CPU of the MCU 102 (hereinafter, referred to merely as "CPU") refers to an output of the encoder of each of the motors Mr1 to Mr4 when the ink ribbon 41 is conveyed by a certain amount to thereby detect the rotation speeds of the respective motors Mr1 to Mr4.

There is a 1:1 inverse proportion between a rotation speed x of each motor (motors Mr1 to Mr4) and a diameter y of each roll (winding roll 48, feeding roll 47, feeding roll 43, and winding roll 44), that is, when the roll diameter is large, the motor rotation speed is low; while when the roll diameter is small, the motor rotation speed is high, and the relationship between the rotation speed x and diameter y can be represented by the following linear expression: $y=-ax+b$. Accordingly, to detect the rotation speed of each motor has the same meaning as to grasp the diameter y of each roll through the linear expression.

Figure 19A:
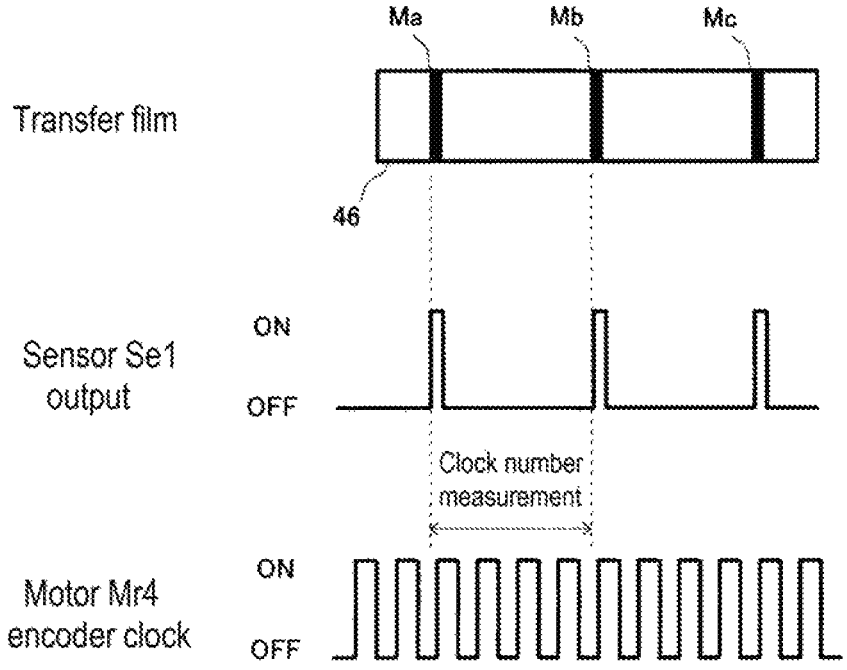
Figure 19B:
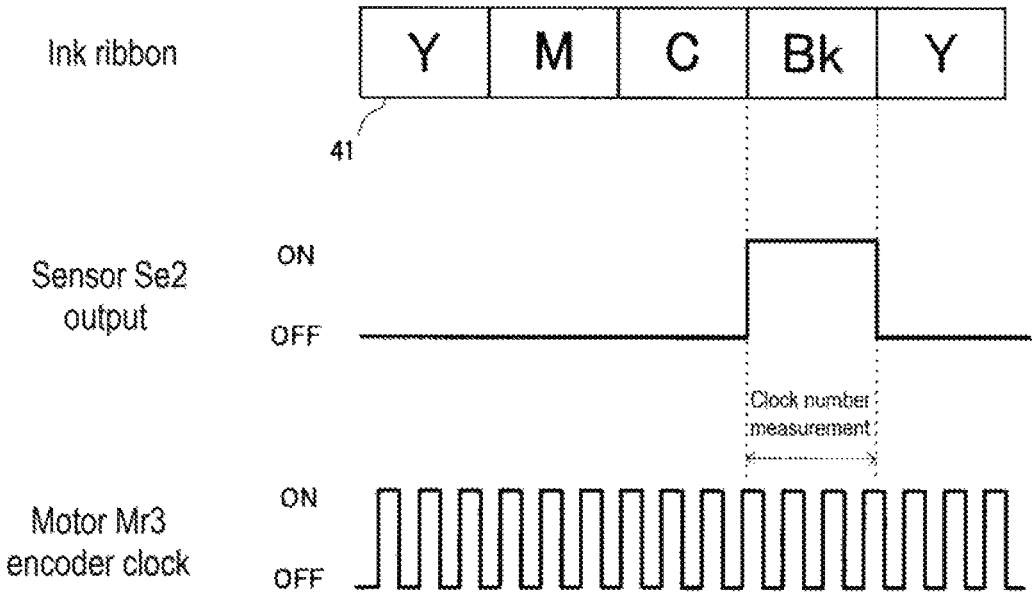

FIG. 19A illustrates the relationship among the transfer film 46, an output of the sensor Se1, and an output (clock) of the encoder for the motor Mr4. In order to grasp the rotation speed of the motor Mr4, the CPU measures the number of clocks output from the encoder for the motor Mr4 during passage of the marks Ma and Mb defining the image formation region R formed on the transfer film 46 through the sensor Se1. FIG. 19B illustrates the relationship among the ink ribbon 41, an output of the sensor Se2, and an output (clock) of the encoder for the motor Mr3. In order to grasp the rotation speed of the motor Mr3, the CPU measures the number of clocks output from the encoder for the motor Mr3 during passage of, e.g., the Bk ink panel of the four-color (Y, M, C, Bk) ink panels repeatedly formed in a face sequential manner on the ink ribbon 41 through the sensor Se2. The measured clock numbers and the rotation speeds of the motors Mr4 and Mr3 are in a 1:1 (proportion) relationship, so that the CPU can grasp (detect) the rotation speeds of the motors Mr4 and Mr3, respectively. The CPU can grasp the rotation speeds of the motors Mr1 and Mr2, respectively, in the same manner.

The above rotation speed detection is performed at image formation to the current image formation region R in principle for image formation to the next image formation region R, and, also, it is performed at initial setting when power is ON. The rotation speed detection at initial setting and that at image formation differ from each other in some points. The following describes the different points.

(1-1) Rotation Speed Detection at Initial Setting

In detecting the rotation speed of each motor at initial setting, the transfer film 46 and ink ribbon 41 are conveyed without being loosened at the waiting position as illustrated in FIG. 6. In order not to loosen the transfer film 46 and ink ribbon 41, the transfer film 46 and ink ribbon 41 are each conveyed at a motor duty ratio set in a state where they are new (see FIG. 16A). In the case of the present embodiment, when the transfer film 46 and ink ribbon 41 are new, the feeding-side motors (motors Mr2 and Mr3) are set to the minimum duty ratio (40%), and the winding-side motors (motors Mr1 and Mr4) are set to the maximum duty ratio (60%). Hereinafter, the minimum and maximum duty ratios are collectively referred to as "set duty ratio".

When the transfer film 46 and ink ribbon 41 are conveyed at the set duty ratio at initial setting, they are not loosened irrespective of the diameter size (thickness) of the winding and feeding rolls 48 and 47 on the transfer film 46 side and winding and feeding rolls 44 and 43 on the ink ribbon 41 side. When the motors Mr1 to Mr4 are driven at the set duty ratio, the back tension with respect to the transfer film 46 and ink ribbon 41 is increased when both the transfer film 46 and ink ribbon 41 are in an empty state; however, the transfer film 46 and ink ribbon 41 undergo idle conveyance (i.e., the transfer film 46 and ink ribbon 41 are conveyed in a state where they are not nipped) at initial setting, so that there is no problem even when the back tension is increased.

In detecting the motor rotation speed at initial setting, the transfer film 46 is conveyed from the feeding spool 47A toward the winding spool 48A (in the direction opposite to that at image formation). As described above, at initial setting, the printer 1 is at the waiting position and, at this time, the previous image formation region R is positioned between the peeling pin 79 (see FIG. 13) and the feeding roll 47, and the subsequent unused image formation region R is still wound around the feeding roll 47. At the waiting position illustrated in FIG. 6, the motors Mr2 and Mr4 are driven at the set duty ratio to convey the marks Ma and Mb defining the above subsequent unused image formation region R wound around the feeding roll 47 to the upstream side of the sensor Se1 and, thereby, the rotation speeds of the respective motors Mr2 and Mr4 are detected.

In the initial setting, the feeding-side motor (motors Mr2 and Mr3) is driven at a duty ratio of 40%. In this case, the rotary shaft of the feeding-side motor is rotated while being pulled by drive force of the winding-side motor (motors Mr1 and Mr4) through the transfer film 46 and ink ribbon 41 (motor rotation speed becomes higher than when driven with no load).

(1-2) Rotation Speed Detection at Image Formation

On the other hand, in detecting the rotation speed of each motor at image formation, the transfer film 46 and ink ribbon 41 are conveyed in the printing direction at the printing position as illustrated in FIG. 7. Then, the number of clocks output from the encoder of each motor is measured to grasp the rotation speed of each motor. Also at the printing position, the pinch rollers 32*a* and 32*b* are brought into pressure-contact with the film conveying roller 49, and the platen roller 45 is brought into pressure-contact with the thermal head 40, so that the transfer film 46 and ink ribbon 41 are conveyed without being loosened.

In detecting the motor rotation speed at image formation, the set duty ratio is not used for the motors Mr1 to Mr4, but a duty ratio stored in the RAM (to be described later in (5)).

(2) Calculation of Drive Amount

Then, the CPU calculates the drive amount of (duty ratio) of each of the motors Mr1 to Mr4 so as to apply a predetermined tension to the transfer film 46 and ink ribbon 41 from the motor rotation speed (roll diameter) grasped in the above (1).

The film conveying roller 49 is not varied in diameter, so that the conveying speed of the transfer film 46 is determined by the driving of the film conveying motor Mr5 (stepping motor). In order to apply a predetermined tension while matching the conveying speed of the transfer film 46 among the rolls 43, 44, 47, and 48, the CPU calculates the duty ratio of the motor Mr1 according to the rotation speed (diameter of the winding roll 44) of the motor Mr1 and the duty ratio of the motor Mr3 according to the rotation speed (diameter of the feeding roll 43) of the motor Mr3 on the ink ribbon 41 side, and calculates the duty ratio of the motor Mr4 according to the rotation speed (diameter of the winding roll 48) of the motor Mr4 and the duty ratio of the motor Mr2 according to the rotation speed (diameter of the feeding roll 47) of the motor Mr2 on the transfer film 46 side. The duty ratio of each of the motors Mr1 to Mr4 according to the rotation speed (roll diameter) and the film conveying speed of the film conveying motor Mr5 may be obtained by referring to a table stored in the ROM and expanded in the RAM or by performing calculation when necessary.

Figures 20A, 20B, 20C:
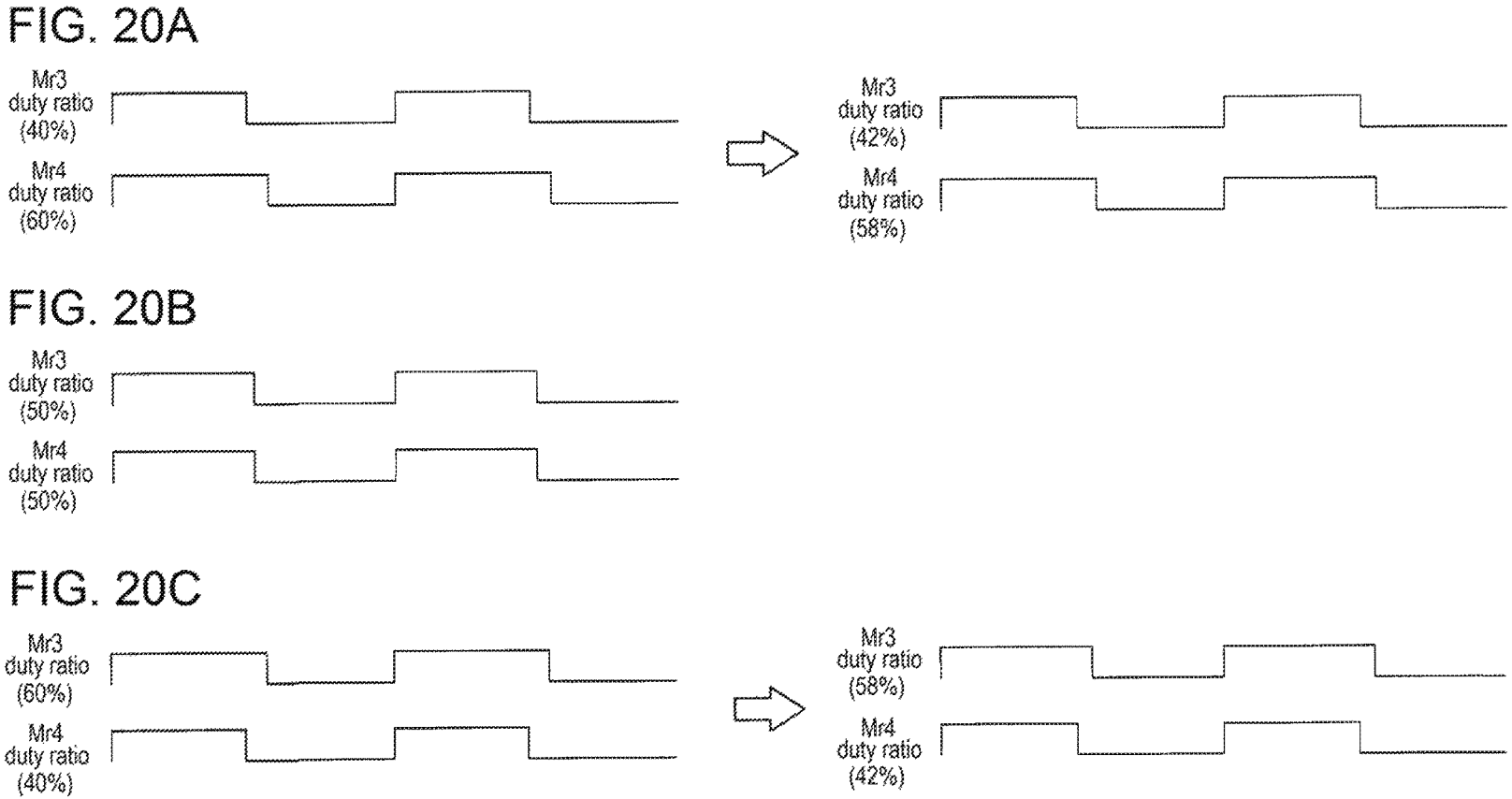

In the present embodiment, when the roll diameter is minimum, an adequate conveying speed is obtained by rotating the motor at 1100 rpm, and in order to apply a predetermined tension at this rotation speed, the motor duty ratio is set to 60%. Conversely, when the roll diameter is maximum, an adequate conveying speed is obtained by rotating the motor at 600 rpm, and in order to apply a predetermined tension at this rotation speed, the motor duty ratio is set to 40%. Further, when the roll diameter is intermediate (½ of the diameter from feeding/winding start to feeding/winding end), an adequate conveying speed is obtained by rotating the motor at 850 rpm, and in order to apply a predetermined tension at this rotation speed, the motor duty ratio is set to 50% (see FIG. 20B).

(3) Drive Amount Adjustment for One Motor (First Drive Source)

Then, the CPU determines which one of the rotation speeds of the motors Mr3 and Mr4 grasped in the above (1) is lower and then determines whether or not the lower rotation speed is lower than a prescribed reference rotation speed. When an affirmative determination is made, the CPU adjusts the drive amount (duty ratio) of the motor determined to have the lower rotating speed in order to reduce the back tension with respect to the transfer film 46 or ink ribbon 41. In the present embodiment, pitch unevenness may occur when the motor rotation speed is lower than 700 rpm, so that the reference rotation speed is set to 700 rpm.

For example, when the rotation speed of the motor Mr3 in the state illustrated in FIG. 16A where the ink ribbon 41 is new is 600 rpm, the duty ratio of the motor Mr3 is set to 40% as calculated in the above (2) (at this time, the rotation speed of the motor Mr4 is 1100 rpm, and the duty ratio thereof is 60%) in order to apply a predetermined tension to the ink ribbon 41; in this case, however, a high back tension is applied in a state where the motor rotation speed is low, causing pitch unevenness by the ink ribbon 41. Thus, in the present embodiment, in order to reduce the back tension with respect to the ink ribbon 41, the duty ratio of the motor Mr3 is set to 42% (see FIG. 20A). In short, in the present embodiment, 2% (2-point) is set as an adjustment amount. However, the conveying speed is not changed, and the motor rotation speed is 600 rpm (the conveying speed of the ink ribbon 41 is not changed even when the duty ratio of the motor Mr1 is adjusted since the ink ribbon 41 is pulled out from the feeding spool 43A by tension force of the motor Mr1).

Conversely, when the rotation speed of the motor Mr4 in the state illustrated in FIG. 16C where the transfer film 46 is empty is 600 rpm, the duty ratio of the motor Mr4 is set to 40% as calculated in the above (2) (at this time, the rotation speed of the motor Mr3 is 1100 rpm, and the duty ratio thereof is 60%) in order to apply a predetermined tension to the transfer film 46; in this case, however, a high back tension is applied in a state where the motor rotation speed is low, causing pitch unevenness by the transfer film 46. Thus, in the present embodiment, in order to reduce the back tension with respect to the transfer film 46, the duty ratio of the motor Mr4 is set to 42% (see FIG. 20C). In short, in the present embodiment, 2% (2-point) is set as an adjustment amount.

In the present embodiment, the drive amounts (duty ratios) of the respective motors Mr3 and Mr4 are adjusted from the drive amounts calculated in the above (2) when the rotation speeds of the motors Mr3 and Mr4 detected in the above (1) are equal to or higher than 600 rpm (minimum rotation speed) and less than 700 rpm (reference rotation speed). The adjustment amount is 2% (2-point) when the rotation speeds of the motors Mr3 and Mr4 are 600 rpm (when the roll diameters of the feeding roll 43 and winding roll 48 are minimum), and the adjustment amount is 0% when the rotation speeds of the motors Mr3 and Mr4 are 700 rpm (reference rotation speed), so that the adjustment amount is 1% (1-point) when the rotation speeds of the motors Mr3 and Mr4 detected in the above (1) are 650 rpm.

In FIGS. 16A to 16C, cases where both the transfer film 46 and ink ribbon 41 are in a brand-new state, an intermediate state, and an empty state have been taken as examples for descriptive convenience; however, the following cases may be considered: a case where one of the transfer film 46 and ink ribbon 41 is in a brand-new state and the other one thereof is in an intermediate or empty state; a case where one of the transfer film 46 and ink ribbon 41 is in an intermediate state and the other one thereof is in a brand-new or empty state; and a case where one of the transfer film 46 and ink ribbon 41 is in an empty state and the other one thereof is in a brand-new or intermediate state. Accordingly, there may be a case where the rotation speeds of both the motors Mr4 and Mr3 fall below 700 rpm. However, since it is determined which one of the rotation speeds of the motors Mr3 and Mr4 is lower, the motor having a lower rotation speed is subjected to adjustment. Thus, it is possible to cope with the above problem 1.

(4) Drive Amount Adjustment for the Other Motor (Second Drive Source)

Then, according to the drive amount of one of the motors Mr4 and Mr3 adjusted in the above (3), the CPU adjusts the drive amount of the other one thereof. In the present embodiment, this adjustment is made such that the absolute value of the adjustment amount of the drive amount of one motor is equal to the absolute value of the adjustment amount of the drive amount of the other motor and that the positive/negative of the adjustment amounts are inverted.

For example, as described in the above (3), in the state illustrated in FIG. 16A, the drive amount of the motor Mr3 is adjusted to reduce the back tension on the ink ribbon 41 side, so that the drive amount of the motor Mr4 is adjusted by that amount (2%) to increase the back tension on the transfer film 46 side. Specifically, in the present embodiment, the duty ratio of the motor Mr4 is reduced from 60% to 58% (see FIG. 20A). On the other hand, in the state illustrated in FIG. 16C, the drive amount of the motor Mr4 is adjusted to reduce the back tension on the transfer film 46 side, so that the drive amount of the motor Mr3 is adjusted by that amount to increase the back tension on the ink ribbon 41 side. Specifically, in the present embodiment, the duty ratio of the motor Mr3 is reduced from 60% to 58% (see FIG. 20C). Thus, it is possible to cope with the above problem 2.

(5) Storage of Drive Amount

In the above (3), the CPU determines which one of the rotation speeds of the motors Mr3 and Mr4 is lower and then determines whether or not the lower rotation speed is lower than the reference rotation speed. In this case, degradation in printing quality due to the slippage of the above problem 2 does not occur (adjustment in the above (3) and (4) is not necessary) when a negative determination is made, so that the duty ratios of the motors Mr1 to Mr4 calculated in the above (2) are stored in the RAM. When an affirmative determination is made, the duty ratios of the motors Mr1 and Mr2 calculated in the above (2) and the duty ratios of the motors Mr3 and Mr4 adjusted in the above (3) and (4) are stored in the RAM in order to prevent degradation in printing quality due to the slippage of the problem 2.

Then, the CPU reads out the duty ratios of the motors Mr1 to Mr4 stored in the RAM when image formation is performed by the image forming section B1 and outputs the read out duty ratios to the actuator control section 104 to thereby drive the motors Mr1 to Mr4 at appropriate duty ratios. Thus, it is possible to prevent the slippage from occurring in the transfer film 46 and thus to form an image in which pitch unevenness is inconspicuous in the image formation region R on the transfer film 46.

3. Operation

Next, the entire operation of the printer 1 according to the present embodiment will be described with emphasis on the CPU of the microcomputer 102.

When the printer 1 is powered ON, initial setting is performed to locate the members constituting the printer 1 at their home (initial) positions (e.g., the state illustrated in FIG. 2) and expand programs and program data stored in the ROM into the RAM. In this initial setting, the above-described drive amount determination processing (see 2-2 (1) to (5)) is executed.

Figure 21:
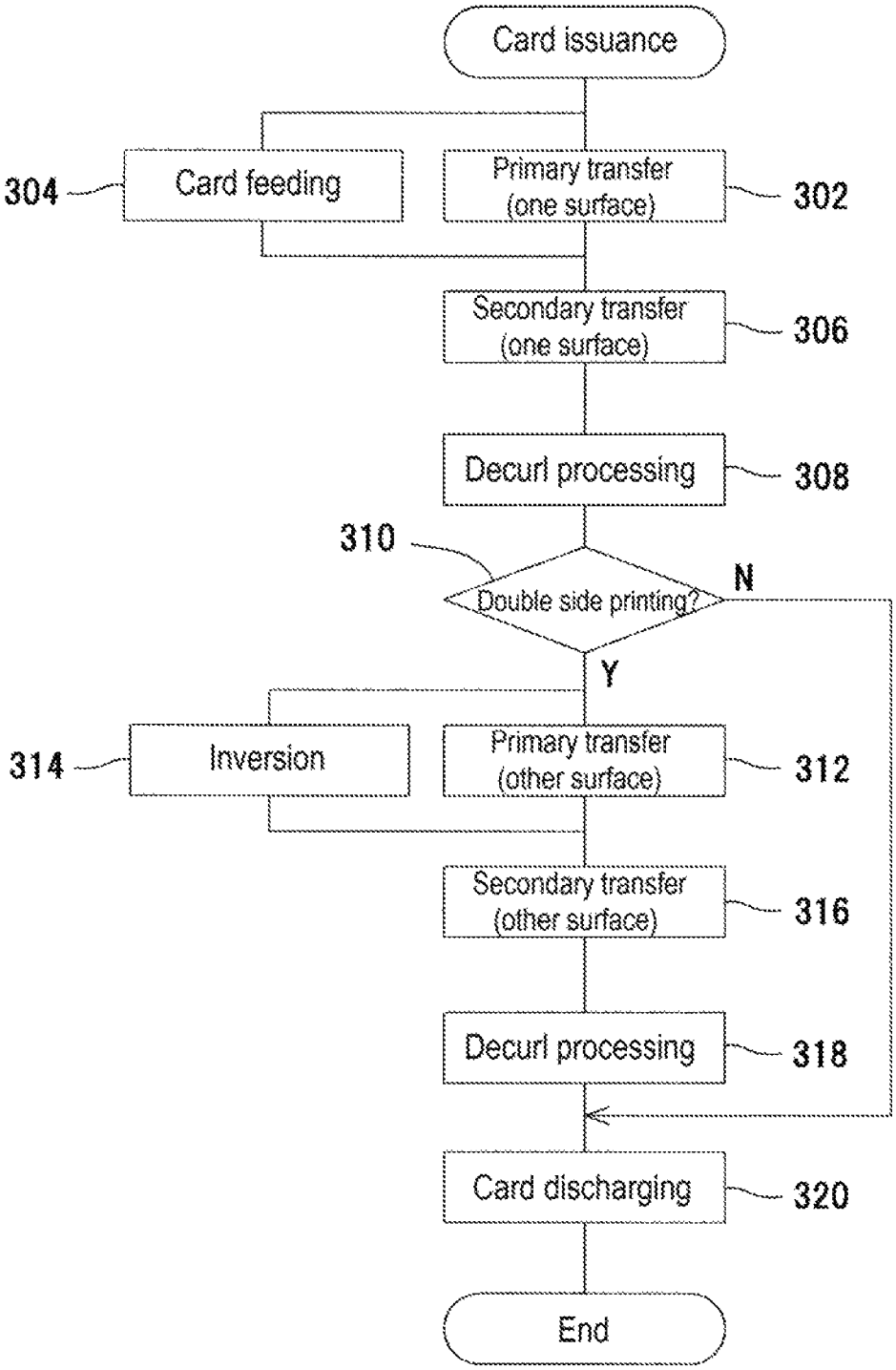
FIG. 21 is a flowchart of a card issuance routine executed by a CPU of a microcomputer unit provided in a control section of the printer according to the embodiment.

The CPU receives a printing instruction through the operation panel section 5 (operation display control section 104) or communication section 101 and then executes a card issuance routine illustrated in FIG. 21. Hereinafter, for simplification, it is assumed that printing data and the like have already been received from the host device 201, that is, the CPU has already received printing data (printing data of Bk and color component printing data of Y, M, C) of one surface side (in the case of one side printing) or of one and the other surface sides (in the case of double side printing) and magnetic or electric recording data from the host device 201 and already stored them in the memory 107. The operation of the printing section B (image forming section B1, transfer section B2) has already been described and will thus be described briefly for avoiding unnecessary duplication.

As illustrated in FIG. 21, in the card issuance routine, in step 302, the image forming section B1 performs primary transfer processing (image formation processing) to form an image (mirror image) on one surface (e.g., front surface) of the transfer film 46. That is, the thermal head 40 of the image forming section B1 is controlled on the basis of the color component printing data of Y, M, C and printing data of Bk stored in the memory 107 to thereby form an image in the image formation region R on the transfer film 46 by overlapping images of Y, M, C, and Bk inks. At this time, the CPU reads out the duty ratios of the respective motors Mr1 to Mr4 stored in the RAN in the above 2-2 (5) and controls the motors Mr1 to Mr4 on the basis of the read out duty ratios. The CPU executes the above-described drive amount determination processing (see 2-2 (1) to (5)) for image formation in the next image formation region R.

In parallel with the primary transfer processing of step 302, the CPU feeds out the card Ca from the medium storage section C, performs recording processing on the card Ca in one or some of the magnetic recording section 24, non-contact type IC recording section 23, and contact type IC recording section 27 constituting the information recording section A on the basis of the magnetic or electric recording data, and then conveys the resultant card Ca to the transfer section B2.

In the next step 306, in the transfer section B2, the CPU performs secondary transfer processing that transfers the image formed on the transfer surface of the transfer film 46 to the card Ca. Prior to the secondary transfer processing, the CPU performs control such that the temperature of a heater constituting the heat roller 33 reaches a predetermined temperature and that the card Ca and the image formed in the image formation region R on the transfer film 46 arrive at the transfer section B2 in synchronization with each other.

The transfer film 46 after secondary transfer processing is separated (peeled off) from the card Ca by the peeling pin 79 disposed between the heat roller 33 and the conveying roller pair 37 and conveyed to the feeding roll 47 side. On the other hand, the card Ca with the image transferred thereto is conveyed on the medium conveying path P2 toward the downstream side decurl mechanism 12. The CPU drives an unillustrated conveying motor to convey the card Ca and stops the driving of the unillustrated conveying motor after the rear end of the card Ca passes through the peeling pin 79.

As a result, both ends of the card Ca are nipped by the conveying roller pairs 37 and 38.

In the next step 308, the CPU executes decurl processing. That is, the CPU rotates the eccentric cam 36 to press downward the decurl unit 33 toward the decurl unit 34 to nip the card Ca between the decurl units 33 and 34, thereby correcting curl of the card Ca. Then, the CPU advances to step 310.

In step 310, the CPU determines whether or not the current printing is double side printing. When making a negative determination, the CPU advances to step 320. When making an affirmative determination, the CPU advances to step 312 where it performs, in the image forming section B1, primary transfer processing to form an image (mirror image) on the other surface (e.g., back surface) side in the next image formation region R on the transfer film 46 in the same manner as in step 302 and then advances to step 316. At this time, the CPU reads out the duty ratios of the motors Mr1 to Mr4 stored in the RAM in the above 2-2 (5) according to the drive amount determination processing in step 302 and controls the motors Mr1 to Mr4 on the basis of the duty ratios read out. The CPU executes the above-described drive amount determination processing for image formation in the next image formation region R.

In parallel with the primary transfer processing of step 312, in the step 314, the CPU conveys the card Ca positioned at the decurl mechanism 12 where it is nipped by the conveying roller pairs 37 and 38 to the rotary unit F through the medium conveying paths P2 and P1 and rotates the card Ca whose opposite ends are nipped by the roller pairs 20 and 21 by 180° (invert the front and back surfaces). In the next step 316, in the transfer section B2, the CPU performs secondary transfer processing that transfers the image formed in the next image formation region R on the transfer film 46 to the other surface of the card Ca in the same manner as in step 306.

Then, in step 318, the CPU executes the decurl processing that corrects curl of the card Ca in the same manner as in step 308. Then, in the next step 320, the CPU discharges the card Ca toward the storage stacker 60 and ends the card issuance routine.

4. Effects and Others

Next, effects and others of the printer 1 of the present embodiment will be described.

4-1. Effects

In the printer 1 according to the present embodiment, it is determined which one of the rotation speeds of the motors Mr3 and Mr4 is lower, and when the lower rotation speed is lower than the reference rotation speed (700 rpm), the drive amount (duty ratio) of the motor having the lower rotation speed is adjusted in order to reduce the back tension with respect to the transfer film 46 or ink ribbon 41. Thus, even when rotation unevenness occurs in the motors Mr3 and Mr4, pitch unevenness is inconspicuous (the problem 1 can be solved), so that a high quality image can be formed on the transfer film 46 (and then on the card Ca).

Further, in the printer 1 according to the present embodiment, when the drive amount (duty ratio) of one of the motors Mr3 and Mr4 that apply the back tension to the transfer film 46 is to be adjusted, the drive amount (duty ratio) of the other one thereof is also adjusted according to the adjustment amount of the one motor. Thus, with the printer 1, it is possible to prevent slippage of the transfer film 46 and ink ribbon 41 (i.e., prevent the transfer film 46 and ink ribbon 41 from excessively advancing) at image formation in the image formation region R on the transfer film 46 by the image forming section B to thereby solve the problem 2, so that a high quality image can be formed on the transfer film 46.

4-2. Modifications

Although a stepping motor is used as the film conveying motor Mr5 in the present embodiment, a DC motor may be used as the film conveying motor Mr5. In this case, the tension with respect to the transfer film 46 can also be adjusted by adjusting the duty ratio of the film conveying motor Mr5 disposed downstream of the image forming section B1. In this case, in order to make balance with the tension to be applied to the ink ribbon 41 by increasing the duty ratio of the motor Mr1. Thus, the tension can be adjusted also by using the motor disposed upstream of the image forming section B1.

The adjustment using the DC motor as the film conveying motor Mr5 may be performed in combination with the adjustment of the drive amounts of the back tension side motors Mr4 and Mr3 disposed upstream of the image forming section B1 as described in the present embodiment. Further, the present invention can be applied to an embodiment with no film conveying roller 49 (and thus with no film conveying motor Mr5) described in the present embodiment where the motor Mr2 that drives the feeding spool 43A is used to manage conveyance of the transfer film 46. In this case, descriptions related to the film conveying motor Mr5 are applied to the motor Mr2.

Further, in the present embodiment, in steps 309 and 319, as in the drive amount determination processing at initial setting, the adjustment amounts of the motors Mr1 to Mr4 are determined by actually conveying the transfer film 46 or ink ribbon 41; however, the present invention is not limited to this. For example, the adjustment amounts of the motors Mr1 to Mr4 may be determined by previously determining (and storing in the ROM) adjustment amounts with respect to the duty ratios of the motors Mr1 to Mr4 after image formation for conveyance of one image formation region R (or Bk ink panel of the ink ribbon 41) and adding the adjustment amounts to the drive amounts of the motors Mr1 to Mr4 calculated on the basis of most recent measurement without actually conveying the transfer film 46 or ink ribbon 41 (hereinafter, referred to conveniently as "simple drive amount determination processing").

In such simple drive amount determination processing, a computation load on the CPU is reduced, whereas repetition of the simple drive amount determination processing many times may cause cumulative error. Thus, the simple drive amount determination processing may be performed in combination with the drive amount determination processing described in steps 309 and 319. That is, after the measurement, the simple drive amount determination processing may be performed until completion of image formation in a predetermined number of the image formation regions R, followed by the drive amount determination processing described in the above 2-2 (1) to (5).

Further, although the encoders are provided respectively in the motors Mr1 to Mr4 in the present embodiment, the encoders may be provided respectively in the feeding spool 47A, winding spool 48A, feeding spool 43A, and winding spool 44A, and outputs from the encoders may be referred to. In this case, grasping accuracy of the conveying amount of the transfer film 46 or ink ribbon 41 may be increased by forming a plurality of slits in the encoder.

Further, in the present embodiment, the mark Mb is detected using the sensor Se3 for cueing (see 1-2-1 (6) (6-2)) during the secondary transfer processing. However, when the conveying distance of the transfer film 46 from the sensor Se3 to the heat roller 33 is longer than the distance thereof from the mark Ma to the image formation start position of FIG. 12A, the mark Ma may be detected using the sensor Se3 for cueing.

Further, although the plate roller 45 is brought into pressure contact with the thermal head 40 in the image forming section B1, the thermal head 40 may be brought into pressure contact with the platen roller 45. In this case, the platen need not necessarily be the exemplified roller, but preferably has a shape that does not affect conveyance of the transfer film 46 or ink ribbon 41. Further, although the heat roller 33 is brought into pressure contact with the platen roller 31 in the transfer section B2, the platen roller 31 may be brought into pressure contact with the heat roller 33.

Further, in the present embodiment, an image to be transferred to one surface of the card Ca is formed in the image formation region R on the transfer film 46 in the image forming section B1 (step 302 of FIG. 21), the image formed in step 302 is transferred to the one surface of the card Ca in the transfer section B2 (step 306), the card Ca is conveyed to the rotary unit F side and rotated by 180° (step 314) in parallel with formation of an image to be transferred to the other surface of the card Ca in the next image formation region R on the transfer film 46 in the image forming section B1 (step 312), and the image formed in step 312 is transferred to the other surface of the card Ca in the transfer section B2. Alternatively, however, the image to be transferred to the other surface of the card Ca may be formed immediately after the image to be transferred to the one surface of the card Ca in the image forming section B1. In this case, after the formation of the images for one and the other surfaces, the image for the one surface is transferred to the one surface of the card Ca in the transfer section B2, followed by conveyance of the card Ca to the rotary unit F side and rotation thereof by 180°, and then the image for the other surface is transferred to the other surface of the card Ca.

Further, in the present embodiment, printing data or magnetic or electric recording data is received from the host device 201; however, the present invention is not limited to this. For example, when the printer 1 is a member of a local network, the above data may be received from a computer connected to the local network other than the host device 201. Further, the magnetic or electric recording data may be received from the operation panel section 5. Further, when the printer 1 can be connected to an external storage device such as a USB or a memory card, the printer 1 can acquire the printing data or magnetic or electric recording data by reading information stored in the external storage device. Further, in place of the printing data (printing data of Bk and color component printing data of Y, M, C), image data (image data of Bk and color component image data of R, G, B) may be received from the host device 201. In this case, received image data may be converted into print data on the printer 1 side.

This application claims priority from Japanese Patent Application No. 2016-076471 incorporated herein by reference.

What is claimed is:

1. An image forming device comprising:

an image forming unit that forms an image on a film-shaped medium using an ink ribbon;

a first conveying unit that has a drive source and conveys the medium while applying a tension thereto;

a second conveying unit that has a drive source and conveys the ink ribbon while applying a tension thereto; and a controller that controls the image forming unit, first conveying unit, and second conveying unit, wherein one of the drive source of the first and second conveying units is a first drive source and the other drive source is a second drive source, and when the controller adjusts a drive amount of the first drive source, the controller also adjusts a drive amount of the second drive source thereof according to the adjustment amount of the first drive source.

2. The image forming device according to claim 1, further comprising:

a first detection unit that detects a rotation speed of the drive source of the first conveying unit; and a second detection unit that detects a rotation speed of the drive source of the second conveying unit, wherein when a smaller one of the rotation speeds of the drive sources detected by the first and second detection units is lower than a prescribed reference rotation speed, the controller adjusts the drive amount of the drive source having the smaller rotation speed as the first drive source.

3. The image forming device according to claim 1, wherein the controller performs adjustment such that the absolute value of the adjustment amount of the first drive source is equal to the absolute value of the adjustment amount of the second drive source and that the respective absolute values of the adjustment amounts are positively/negatively inverted each other.

4. The image forming device according to claim 1, wherein the controller adjusts the drive amount of the first drive source in such a way that a back tension to be applied to the medium or ink ribbon is reduced.

5. The image forming device according to claim 1, wherein the first and second conveying units each have an upstream-side drive source and a downstream-side drive source respectively disposed upstream and downstream of the image forming unit, and when a smaller one of the rotation speeds of the upstream-side drive sources of the respective first and second conveying units is lower than a prescribed reference rotation speed, the controller adjusts the drive amount of the upstream-side drive source having the smaller rotation speed as the first drive source and adjusts the drive amount of the other upstream-side drive source according to the adjustment amount of the first drive source as the second drive source.

6. The image forming device according to claim 5, wherein the upstream-side drive source and downstream-side drive source each drive a winding spool or a feeding spool for the medium and ink ribbon, and the winding spool and feeding spool for the medium and ink ribbon are disposed opposite to each other on the upstream and downstream sides of the image forming unit.

7. The image forming device according to claim 6, further comprising encoders that respectively detect rotation amounts of the upstream-side and downstream-side drive sources or the winding and feeding spools, wherein the controller refers to an output of the encoder while the medium and ink ribbon are conveyed by a certain amount by the first and second conveying units to detect the drive amounts of the respective upstream-side and downstream-side drive sources.

8. The image forming device according to claim 5, wherein the upstream-side and downstream-side drive sources are each a PWM controlled DC motor, and the controller changes a duty ratio of the DC motor in PWM control to adjust the drive amounts of the first and the second upstream-side drive sources.

9. The image forming device according to claim 8, wherein the controller increases the duty ratio of the first upstream-side drive source and reduces the second upstream-side drive source by an increase in the duty ratio of the first upstream-side drive source.

* * * * *